US010235933B2

(12) United States Patent
Nathan et al.

(10) Patent No.: US 10,235,933 B2
(45) Date of Patent: Mar. 19, 2019

(54) SYSTEM AND METHOD FOR COMPENSATION OF NON-UNIFORMITIES IN LIGHT EMITTING DEVICE DISPLAYS

(71) Applicant: Ignis Innovation Inc., Waterloo (CA)

(72) Inventors: Arokia Nathan, Cambridge (GB); Gholamreza Chaji, Waterloo (CA); Stefan Alexander, Elmira (CA); Peyman Servati, Vancouver (CA); Richard I-Heng Huang, Waterloo (CA); Corbin Church, Westmount (CA)

(73) Assignee: Ignis Innovation Inc., Waterloo (CA)

( * ) Notice: Subject to any disclaimer, the term of this patent is extended or adjusted under 35 U.S.C. 154(b) by 58 days.

(21) Appl. No.: 14/490,513

(22) Filed: Sep. 18, 2014

(65) Prior Publication Data

US 2015/0002378 A1 Jan. 1, 2015

Related U.S. Application Data

(63) Continuation of application No. 14/135,789, filed on Dec. 20, 2013, now abandoned, which is a (Continued)

(30) Foreign Application Priority Data

Apr. 12, 2005 (CA) ..... 2504571

(51) Int. Cl.
*G09G 3/3233* (2016.01)
*G09G 3/3241* (2016.01)

(52) U.S. Cl.
CPC ..... *G09G 3/3233* (2013.01); *G09G 3/3241* (2013.01); *G09G 2300/0842* (2013.01); (Continued)

(58) Field of Classification Search
CPC ..... G09G 3/3233; G09G 3/3241; G09G 2300/0842; G09G 2320/0233; (Continued)

(56) References Cited

U.S. PATENT DOCUMENTS 3,506,851 A 4/1970 Polkinghorn et al.
3,774,055 A 11/1973 Bapat et al.
(Continued)

FOREIGN PATENT DOCUMENTS

CA 1 294 034 1/1992
CA 2 109 951 11/1992
(Continued)

OTHER PUBLICATIONS

International Search Report, PCT/IB2014/066932, 3 pages, dated Mar. 24, 2015.
(Continued)

*Primary Examiner* — Mark Regn
(74) *Attorney, Agent, or Firm* — Stratford Managers Corporation

(57) ABSTRACT

A display degradation compensation system and method for adjusting the operating conditions for pixels in an OLED display to compensate for non-uniformity or aging of the display. The system or method sets an initial value for at least one of peak luminance and an operating condition, calculates compensation values for the pixels in the display, determines the number of pixels having compensation values larger than a predetermined threshold compensation value, and if the determined number of pixels having compensation values larger than said predetermined threshold value is greater than a predetermined threshold number, adjusts the set value until said determined number of pixels is less than said predetermined threshold number.

8 Claims, 18 Drawing Sheets

Related U.S. Application Data continuation-in-part of application No. 12/946,601, filed on Nov. 15, 2010, now abandoned, which is a continuation-in-part of application No. 11/402,624, filed on Apr. 12, 2006, now Pat. No. 7,868,857.

(52) U.S. Cl.
CPC ..... *G09G 2320/029* (2013.01); *G09G 2320/0233* (2013.01); *G09G 2320/0285* (2013.01); *G09G 2320/0295* (2013.01); *G09G 2320/043* (2013.01); *G09G 2320/045* (2013.01); *G09G 2320/0666* (2013.01)

(58) Field of Classification Search
CPC ..... G09G 2320/029; G09G 2320/0295; G09G 2320/043; G09G 2320/0666
USPC ..... 345/77
See application file for complete search history.

(56) References Cited

U.S. PATENT DOCUMENTS 4,090,096 A 5/1978 Nagami
4,160,934 A 7/1979 Kirsch
4,354,162 A 10/1982 Wright
4,943,956 A 7/1990 Noro
4,996,523 A 2/1991 Bell et al.
5,153,420 A 10/1992 Hack et al.
5,198,803 A 3/1993 Shie et al.
5,204,661 A 4/1993 Hack et al.
5,266,515 A 11/1993 Robb et al.
5,489,918 A 2/1996 Mosier
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,714,968 A 2/1998 Ikeda
5,723,950 A 3/1998 Wei et al.
5,744,824 A 4/1998 Kousai et al.
5,745,660 A 4/1998 Kolpatzik et al.
5,748,160 A 5/1998 Shieh et al.
5,815,303 A 9/1998 Berlin
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,945,972 A 8/1999 Okumura et al.
5,949,398 A 9/1999 Kim
5,952,789 A 9/1999 Stewart et al.
5,952,991 A 9/1999 Akiyama et al.
5,982,104 A 11/1999 Sasaki et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,144,222 A 11/2000 Ho
6,177,915 B1 1/2001 Beeteson et al.
6,229,506 B1 5/2001 Dawson et al.
6,229,508 B1 5/2001 Kane
6,246,180 B1 6/2001 Nishigaki
6,252,248 B1 6/2001 Sano et al.
6,259,424 B1 7/2001 Kurogane
6,262,589 B1 7/2001 Tamukai
6,271,825 B1 8/2001 Greene et al.
6,288,696 B1 9/2001 Holloman
6,304,039 B1 10/2001 Appelberg et al.
6,307,322 B1 10/2001 Dawson et al.
6,310,962 B1 10/2001 Chung et al.
6,320,325 B1 11/2001 Cok et al.
6,323,631 B1 11/2001 Juang
6,356,029 B1 3/2002 Hunter
6,373,454 B1 4/2002 Knapp et al.
6,392,617 B1 5/2002 Gleason
6,414,661 B1 7/2002 Shen et al.
6,417,825 B1 7/2002 Stewart et al.
6,433,488 B1 8/2002 Bu
6,437,106 B1 8/2002 Stoner et al.
6,445,369 B1 9/2002 Yang et al.
6,475,845 B2 11/2002 Kimura
6,501,098 B2 12/2002 Yamazaki
6,501,466 B1 12/2002 Yamagishi et al.
6,522,315 B2 2/2003 Ozawa et al.
6,525,683 B1 2/2003 Gu
6,531,827 B2 3/2003 Kawashima
6,542,138 B1 4/2003 Shannon et al.
6,580,408 B1 6/2003 Bae et al.
6,580,657 B2 6/2003 Sanford et al.
6,583,398 B2 6/2003 Harkin
6,583,775 B1 6/2003 Sekiya et al.
6,594,606 B2 7/2003 Everitt
6,618,030 B2 9/2003 Kane et al.
6,639,244 B1 10/2003 Yamazaki et al.
6,668,645 B1 12/2003 Gilmour et al.
6,677,713 B1 1/2004 Sung
6,680,580 B1 1/2004 Sung
6,687,266 B1 2/2004 Ma et al.
6,690,000 B1 2/2004 Muramatsu et al.
6,690,344 B1 2/2004 Takeuchi et al.
6,693,388 B2 2/2004 Oomura
6,693,610 B2 2/2004 Shannon et al.
6,697,057 B2 2/2004 Koyama et al.
6,720,942 B2 4/2004 Lee et al.
6,724,151 B2 4/2004 Yoo
6,734,636 B2 5/2004 Sanford et al.
6,738,034 B2 5/2004 Kaneko et al.
6,738,035 B1 5/2004 Fan
6,753,655 B2 6/2004 Shih et al.
6,753,834 B2 6/2004 Mikami et al.
6,756,741 B2 6/2004 Li
6,756,952 B1 6/2004 Decaux et al.
6,756,985 B1 6/2004 Furuhashi et al.
6,771,028 B1 8/2004 Winters
6,777,712 B2 8/2004 Sanford et al.
6,777,888 B2 8/2004 Kondo
6,781,567 B2 8/2004 Kimura
6,806,497 B2 10/2004 Jo
6,806,638 B2 10/2004 Lin et al.
6,806,857 B2 10/2004 Sempel et al.
6,809,706 B2 10/2004 Shimoda
6,815,975 B2 11/2004 Nara et al.
6,828,950 B2 12/2004 Koyama
6,853,371 B2 2/2005 Miyajima et al.
6,859,193 B1 2/2005 Yumoto
6,873,117 B2 3/2005 Ishizuka
6,876,346 B2 4/2005 Anzai et al.
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky et al.
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura et al.
6,940,214 B1 9/2005 Komiya et al.
6,943,500 B2 9/2005 LeChevalier
6,947,022 B2 9/2005 McCartney
6,954,194 B2 10/2005 Matsumoto et al.
6,956,547 B2 10/2005 Bae et al.
6,975,142 B2 12/2005 Azami et al.
6,975,332 B2 12/2005 Arnold et al.
6,995,510 B2 2/2006 Murakami et al.
6,995,519 B2 2/2006 Arnold et al.
7,023,408 B2 4/2006 Chen et al.

(56) References Cited

U.S. PATENT DOCUMENTS 7,027,015 B2 4/2006 Booth, Jr. et al.
7,027,078 B2 4/2006 Reihl
7,034,793 B2 4/2006 Sekiya et al.
7,038,392 B2 5/2006 Libsch et al.
7,057,359 B2 6/2006 Hung et al.
7,061,451 B2 6/2006 Kimura
7,064,733 B2 6/2006 Cok et al.
7,071,932 B2 7/2006 Libsch et al.
7,088,051 B1 8/2006 Cok
7,088,052 B2 8/2006 Kimura
7,102,378 B2 9/2006 Kuo et al.
7,106,285 B2 9/2006 Naugler
7,112,820 B2 9/2006 Chang et al.
7,116,058 B2 10/2006 Lo et al.
7,119,493 B2 10/2006 Fryer et al.
7,122,835 B1 10/2006 Ikeda et al.
7,127,380 B1 10/2006 Iverson et al.
7,129,914 B2 10/2006 Knapp et al.
7,164,417 B2 1/2007 Cok
7,193,589 B2 3/2007 Yoshida et al.
7,224,332 B2 5/2007 Cok
7,227,519 B1 6/2007 Kawase et al.
7,245,277 B2 7/2007 Ishizuka
7,248,236 B2 7/2007 Nathan et al.
7,262,753 B2 8/2007 Tanghe et al.
7,274,363 B2 9/2007 Ishizuka et al.
7,310,092 B2 12/2007 Forrest et al.
7,315,295 B2 1/2008 Kimura
7,321,348 B2 1/2008 Cok et al.
7,339,560 B2 3/2008 Sun
7,355,574 B1 4/2008 Leon et al.
7,358,941 B2 4/2008 Ono et al.
7,368,868 B2 5/2008 Sakamoto
7,411,571 B2 8/2008 Huh
7,414,600 B2 8/2008 Nathan et al.
7,423,617 B2 9/2008 Giraldo et al.
7,474,285 B2 1/2009 Kimura
7,502,000 B2 3/2009 Yuki et al.
7,528,812 B2 5/2009 Tsuge et al.
7,535,449 B2 5/2009 Miyazawa
7,554,512 B2 6/2009 Steer
7,569,849 B2 8/2009 Nathan et al.
7,576,718 B2 8/2009 Miyazawa
7,580,012 B2 8/2009 Kim et al.
7,589,707 B2 9/2009 Chou
7,609,239 B2 10/2009 Chang
7,619,594 B2 11/2009 Hu
7,619,597 B2 11/2009 Nathan et al.
7,633,470 B2 12/2009 Kane
7,656,370 B2 2/2010 Schneider et al.
7,800,558 B2 9/2010 Routley et al.
7,847,764 B2 12/2010 Cok et al.
7,859,492 B2 12/2010 Kohno
7,868,859 B2 1/2011 Tomida et al.
7,876,294 B2 1/2011 Sasaki et al.
7,924,249 B2 4/2011 Nathan et al.
7,932,883 B2 4/2011 Klompenhouwer et al.
7,969,390 B2 6/2011 Yoshida
7,978,187 B2 7/2011 Nathan et al.
7,994,712 B2 8/2011 Sung et al.
8,026,876 B2 9/2011 Nathan et al.
8,049,420 B2 11/2011 Tamura et al.
8,077,123 B2 12/2011 Naugler, Jr.
8,115,707 B2 2/2012 Nathan et al.
8,223,177 B2 7/2012 Nathan et al.
8,232,939 B2 7/2012 Nathan et al.
8,259,044 B2 9/2012 Nathan et al.
8,264,431 B2 9/2012 Bulovic et al.
8,279,143 B2 10/2012 Nathan et al.
8,339,386 B2 12/2012 Leon et al.
2001/0002703 A1 6/2001 Koyama
2001/0009283 A1 7/2001 Arao et al.
2001/0024181 A1 9/2001 Kubota
2001/0024186 A1* 9/2001 Kane ..... G09G 3/3233 345/98
2001/0026257 A1 10/2001 Kimura
2001/0026725 A1 10/2001 Petteruti et al.
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052606 A1 12/2001 Sempel et al.
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai et al.
2002/0018034 A1 2/2002 Ohki et al.
2002/0030190 A1 3/2002 Ohtani et al.
2002/0047565 A1 4/2002 Nara et al.
2002/0052086 A1 5/2002 Maeda
2002/0067134 A1 6/2002 Kawashima
2002/0084463 A1 7/2002 Sanford et al.
2002/0101172 A1 8/2002 Bu
2002/0105279 A1 8/2002 Kimura
2002/0117722 A1 8/2002 Osada et al.
2002/0122308 A1 9/2002 Ikeda
2002/0158587 A1 10/2002 Komiya
2002/0158666 A1 10/2002 Azami et al.
2002/0158823 A1 10/2002 Zavracky et al.
2002/0167474 A1 11/2002 Everitt
2002/0180369 A1 12/2002 Koyama
2002/0180721 A1 12/2002 Kimura et al.
2002/0186214 A1 12/2002 Siwinski
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2003/0020413 A1 1/2003 Oomura
2003/0030603 A1 2/2003 Shimoda
2003/0043088 A1 3/2003 Booth et al.
2003/0057895 A1 3/2003 Kimura
2003/0058226 A1 3/2003 Bertram et al.
2003/0062524 A1 4/2003 Kimura
2003/0063081 A1 4/2003 Kimura et al.
2003/0071821 A1 4/2003 Sundahl et al.
2003/0076048 A1 4/2003 Rutherford
2003/0090447 A1 5/2003 Kimura
2003/0090481 A1 5/2003 Kimura
2003/0107560 A1 6/2003 Yumoto et al.
2003/0111966 A1 6/2003 Mikami et al.
2003/0122745 A1 7/2003 Miyazawa
2003/0122813 A1 7/2003 Ishizuki et al.
2003/0142088 A1 7/2003 LeChevalier
2003/0151569 A1 8/2003 Lee et al.
2003/0156101 A1 8/2003 Le Chevalier
2003/0174152 A1 9/2003 Noguchi
2003/0179626 A1 9/2003 Sanford et al.
2003/0197663 A1 10/2003 Lee et al.
2003/0210256 A1 11/2003 Mori et al.
2003/0230141 A1 12/2003 Gilmour et al.
2003/0230980 A1 12/2003 Forrest et al.
2003/0231148 A1 12/2003 Lin et al.
2004/0032382 A1 2/2004 Cok et al.
2004/0046164 A1* 3/2004 Kobayashi ..... G09G 3/325 257/13
2004/0066357 A1 4/2004 Kawasaki
2004/0070557 A1 4/2004 Asano et al.
2004/0070565 A1 4/2004 Nayar et al.
2004/0090186 A1 5/2004 Kanauchi et al.
2004/0090400 A1 5/2004 Yoo
2004/0095297 A1 5/2004 Libsch et al.
2004/0100427 A1 5/2004 Miyazawa
2004/0108518 A1 6/2004 Jo
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0174347 A1 9/2004 Sun et al.
2004/0174354 A1 9/2004 Ono et al.
2004/0178743 A1 9/2004 Miller et al.

(56) References Cited

U.S. PATENT DOCUMENTS

2004/0183759 A1 9/2004 Stevenson et al.
2004/0196275 A1 10/2004 Hattori
2004/0207615 A1 10/2004 Yumoto
2004/0239596 A1 12/2004 Ono et al.
2004/0252089 A1 12/2004 Ono et al.
2004/0257313 A1 12/2004 Kawashima et al.
2004/0257353 A1 12/2004 Imamura et al.
2004/0257355 A1 12/2004 Naugler
2004/0263437 A1 12/2004 Hattori
2004/0263444 A1 12/2004 Kimura
2004/0263445 A1 12/2004 Inukai et al.
2004/0263541 A1 12/2004 Takeuchi et al.
2005/0007355 A1 1/2005 Miura
2005/0007357 A1 1/2005 Yamashita et al.
2005/0007392 A1 1/2005 Kasai et al.
2005/0017650 A1 1/2005 Fryer et al.
2005/0024081 A1 2/2005 Kuo et al.
2005/0024393 A1 2/2005 Kondo et al.
2005/0030267 A1 2/2005 Tanghe et al.
2005/0057484 A1 3/2005 Diefenbaugh et al.
2005/0057580 A1 3/2005 Yamano et al.
2005/0067970 A1 3/2005 Libsch et al.
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki et al.
2005/0088102 A1* 4/2005 Ferguson et al. ..... 315/149
2005/0088103 A1 4/2005 Kageyama et al.
2005/0104830 A1* 5/2005 Kogure et al. ..... 345/92
2005/0110420 A1 5/2005 Arnold et al.
2005/0110807 A1 5/2005 Chang
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0179626 A1 8/2005 Yuki et al.
2005/0179628 A1 8/2005 Kimura
2005/0185200 A1 8/2005 Tobol
2005/0200575 A1 9/2005 Kim et al.
2005/0206590 A1 9/2005 Sasaki et al.
2005/0219184 A1 10/2005 Zehner et al.
2005/0248515 A1 11/2005 Naugler et al.
2005/0269959 A1 12/2005 Uchino et al.
2005/0269960 A1 12/2005 Ono et al.
2005/0280615 A1 12/2005 Cok et al.
2005/0280766 A1 12/2005 Johnson et al.
2005/0285822 A1 12/2005 Reddy et al.
2005/0285825 A1 12/2005 Eom et al.
2006/0001613 A1 1/2006 Routley et al.
2006/0007072 A1 1/2006 Choi et al.
2006/0012310 A1 1/2006 Chen et al.
2006/0012311 A1 1/2006 Ogawa
2006/0027807 A1 2/2006 Nathan et al.
2006/0030084 A1 2/2006 Young
2006/0038758 A1 2/2006 Routley et al.
2006/0038762 A1 2/2006 Chou
2006/0066533 A1 3/2006 Sato et al.
2006/0077135 A1 4/2006 Cok et al.
2006/0082523 A1 4/2006 Guo et al.
2006/0092185 A1 5/2006 Jo et al.
2006/0097628 A1 5/2006 Suh et al.
2006/0097631 A1 5/2006 Lee
2006/0103611 A1 5/2006 Choi
2006/0125734 A1* 6/2006 Cok ..... G09G 3/3216 345/76
2006/0149493 A1 7/2006 Sambandan et al.
2006/0170623 A1 8/2006 Naugler, Jr. et al.
2006/0176250 A1 8/2006 Nathan et al.
2006/0208961 A1 9/2006 Nathan et al.
2006/0232522 A1 10/2006 Roy et al.
2006/0244697 A1 11/2006 Lee et al.
2006/0261841 A1 11/2006 Fish
2006/0273997 A1 12/2006 Nathan et al.
2006/0284801 A1 12/2006 Yoon et al.
2006/0284895 A1 12/2006 Marcu et al.
2006/0290618 A1 12/2006 Goto
2007/0001937 A1 1/2007 Park et al.
2007/0001939 A1 1/2007 Hashimoto et al.
2007/0008268 A1 1/2007 Park et al.
2007/0008297 A1 1/2007 Bassetti
2007/0057873 A1 3/2007 Uchino et al.
2007/0069998 A1 3/2007 Naugler et al.
2007/0075727 A1 4/2007 Nakano et al.
2007/0076226 A1 4/2007 Klompenhouwer et al.
2007/0080905 A1 4/2007 Takahara
2007/0080906 A1 4/2007 Tanabe
2007/0080908 A1 4/2007 Nathan et al.
2007/0097038 A1 5/2007 Yamazaki et al.
2007/0097041 A1 5/2007 Park et al.
2007/0103419 A1 5/2007 Uchino et al.
2007/0115221 A1 5/2007 Buchhauser et al.
2007/0182671 A1 8/2007 Nathan et al.
2007/0236517 A1 10/2007 Kimpe
2007/0241999 A1 10/2007 Lin
2007/0273294 A1 11/2007 Nagayama
2007/0285359 A1 12/2007 Ono
2007/0290958 A1 12/2007 Cok
2007/0296672 A1 12/2007 Kim et al.
2008/0001525 A1 1/2008 Chao et al.
2008/0001544 A1 1/2008 Murakami et al.
2008/0036708 A1 2/2008 Shirasaki
2008/0042942 A1 2/2008 Takahashi
2008/0042948 A1 2/2008 Yamashita et al.
2008/0048951 A1 2/2008 Naugler, Jr. et al.
2008/0055209 A1 3/2008 Cok
2008/0074413 A1 3/2008 Ogura
2008/0088549 A1 4/2008 Nathan et al.
2008/0088648 A1 4/2008 Nathan et al.
2008/0117144 A1 5/2008 Nakano et al.
2008/0150847 A1 6/2008 Kim et al.
2008/0158115 A1 7/2008 Cordes et al.
2008/0231558 A1 9/2008 Naugler
2008/0231562 A1 9/2008 Kwon
2008/0252571 A1 11/2008 Hente et al.
2008/0290805 A1 11/2008 Yamada et al.
2008/0297055 A1 12/2008 Miyake et al.
2009/0058772 A1 3/2009 Lee
2009/0146926 A1 6/2009 Sung et al.
2009/0160743 A1 6/2009 Tomida et al.
2009/0174628 A1 7/2009 Wang et al.
2009/0184901 A1 7/2009 Kwon
2009/0195483 A1 8/2009 Naugler, Jr. et al.
2009/0201281 A1 8/2009 Routley et al.
2009/0213046 A1 8/2009 Nam
2010/0004891 A1 1/2010 Ahlers et al.
2010/0039422 A1 2/2010 Seto
2010/0060911 A1 3/2010 Marcu et al.
2010/0165002 A1 7/2010 Ahn
2010/0194670 A1 8/2010 Cok
2010/0207960 A1 8/2010 Kimpe et al.
2010/0225630 A1 9/2010 Levey et al.
2010/0277400 A1 11/2010 Jeong
2010/0315319 A1 12/2010 Cok et al.
2011/0069051 A1 3/2011 Nakamura et al.
2011/0069089 A1 3/2011 Kopf et al.
2011/0074750 A1 3/2011 Leon
2011/0149166 A1 6/2011 Botzas et al.
2011/0227964 A1 9/2011 Chaji et al.
2011/0242074 A1 10/2011 Bert
2011/0273399 A1 11/2011 Lee
2011/0293480 A1 12/2011 Mueller
2012/0056558 A1 3/2012 Toshiya et al.
2012/0062565 A1 3/2012 Fuchs et al.
2012/0299978 A1 11/2012 Chaji
2013/0027381 A1 1/2013 Nathan et al.
2013/0057595 A1 3/2013 Nathan et al.

(56) References Cited

U.S. PATENT DOCUMENTS

| | | | |
|---|---|---|---|
| 2013/0201223 | A1 | 8/2013 | Li |
| 2014/0111567 | A1 | 4/2014 | Arokia |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CN | 1381032 | | 11/2002 |
| CN | 1448908 | | 10/2003 |
| CN | 1760945 | | 4/2006 |
| CN | 100375141 | C | 3/2008 |
| CN | 102187679 | A | 9/2011 |
| CN | 102414737 | A | 4/2012 |
| CN | 103051917 | A | 4/2013 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-145197 | | 5/2004 |
| JP | 2004-287345 | | 10/2004 |
| JP | 2005-057217 | | 3/2005 |
| JP | 4-158570 | | 10/2008 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003-063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/055920 | | 5/2009 |
| WO | WO 2010/023270 | | 3/2010 |
| WO | WO 2011/041224 | A1 | 4/2011 |

OTHER PUBLICATIONS

International Written Opinion, PCT/IB2014/066932, 4 pages, dated Mar. 24, 2015.

Ahnood et al.: "Effect of threshold voltage instability on field effect mobility in thin film transistors deduced from constant current measurements"; dated Aug. 2009.

Alexander et al.: "Pixel circuits and drive schemes for glass and elastic AMOLED displays"; dated Jul. 2005 (9 pages).

Alexander et al.: "Unique Electrical Measurement Technology for Compensation, Inspection, and Process Diagnostics of AMOLED HDTV"; dated May 2010 (4 pages).

Ashtiani et al.: "AMOLED Pixel Circuit With Electronic Compensation of Luminance Degradation"; dated Mar. 2007 (4 pages).

Chaji et al.: "A Current-Mode Comparator for Digital Calibration of Amorphous Silicon AMOLED Displays"; dated Jul. 2008 (5 pages).

Chaji et al.: "A fast settling current driver based on the CCII for AMOLED displays"; dated Dec. 2009 (6 pages).

Chaji et al.: "A Low-Cost Stable Amorphous Silicon AMOLED Display with Full V~T- and V~O~L~E~D Shift Compensation"; dated May 2007 (4 pages).

Chaji et al.: "A low-power driving scheme for a-Si:H active-matrix organic light-emitting diode displays"; dated Jun. 2005 (4 pages).

Chaji et al.: "A low-power high-performance digital circuit for deep submicron technologies"; dated Jun. 2005 (4 pages).

Chaji et al.: "A novel a-Si:H AMOLED pixel circuit based on short-term stress stability of a-Si:H TFTs"; dated Oct. 2005 (3 pages).

Chaji et al.: "A Novel Driving Scheme and Pixel Circuit for AMOLED Displays"; dated Jun. 2006 (4 pages).

Chaji et al.: "A Novel Driving Scheme for High Resolution Large-area a-Si:H AMOLED displays"; dated Aug. 2005 (3 pages).

(56) References Cited

OTHER PUBLICATIONS

Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated My 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report for EP Application No. EP 10166143, dated Sep. 3, 2010 (2 pages).
European Search Report for European Application No. EP 11739485.8-1904 dated Aug. 6, 2013, (14 pages).
European Search Report for European Application No. EP 011122313 dated Sep. 14, 2005 (4 pages).
European Search Report for European Application No. EP 04786661 dated Mar. 9, 2009.
European Search Report for European Application No. EP 05759141 dated Oct. 30, 2009 (2 pages).
European Search Report for European Application No. EP 05819617 dated Jan. 30, 2009.
European Search Report for European Application No. EP 06 70 5133 dated Jul. 18, 2008.
European Search Report for European Application No. EP 06721798 dated Nov. 12, 2009 (2 pages).
European Search Report for European Application No. EP 07719579 dated May 20, 2009.
European Search Report for European Application No. EP 07815784 dated Jul. 20, 2010 (2 pages).
European Search Report for European Application No. EP 07710608.6 dated Mar. 19, 2010 (7 pages).
European Search Report, Application No. EP 10834294.0-1903, dated Apr. 8, 2013, (9 pages).
European Supplementary Search Report corresponding to European Application No. EP 04786662 dated Jan. 19, 2007 (2 pages).
Extended European Search Report dated Apr. 27, 2011 issued during prosecution of European patent application No. EP 09733076.5 (13 pages).
Extended European Search Report dated Jul. 11, 2012 which issued in corresponding European Patent Application No. EP 11191641.7 (14 pages).
Extended European Search Report dated Nov. 29, 2012, issued in European Patent Application No. EP 11168677.0 (13 page).
Fossum, Eric R.. "Active Pixel Sensors: Are CCD's Dinosaurs?" SPIE: Symposium on Electronic Imaging. Feb. 1, 1993 (13 pages).
International Preliminary Report on Patentability for International Application No. PCT/CA2005/001007 dated Oct. 16, 2006, 4 pages.
International Search Report corresponding to International Application No. PCT/IB2011/050502, dated Jun. 27, 2011 (6 pages).
International Search Report corresponding to International Application No. PCT/CA2004/001742, Canadian Patent Office, dated Feb. 21, 2005 (2 pages).
International Search Report corresponding to International Application No. PCT/IB2010/055541 filed Dec. 1, 2010, dated May 26, 2011; 5 pages.
International Search Report corresponding to International Application No. PCT/IB2011/055135, Canadian Patent Office, dated Apr. 16, 2012 (5 pages).
International Search Report for Application No. PCT/IB2010/055486, dated Apr. 19, 2011, 5 pages.
International Search Report for International Application No. PCT/CA2005/001007 dated Oct. 18, 2005.
International Search Report for International Application No. PCT/CA2007/000652 dated Jul. 25, 2007.
European Search Report for European Application No. PCT/CA2006/000177 dated Jun. 2, 2006.
International Search Report for International Application No. PCT/CA2004/001741 dated Feb. 21, 2005.
International Search Report for PCT Application No. PCT/CA2009/001769, dated Apr. 8, 2010 (3 pages).
International Search Report dated Dec. 3, 2002, issued in International Patent Application No. PCT/JP02/09668 (4 pages).
International Search Report dated Jul. 30, 2009 for International Application No. PCT/CA2009/000501 (4 pages).
International Search Report dated Mar. 21, 2006 issued in International Patent Application No. PCT/CA2005/001897 (2 pages).
International Search Report, PCT/IB2012/052372, dated Sep. 12, 2012 (3 pages).
International Searching Authority Search Report, PCT/IB2010/055481, dated Apr. 7, 2011, 3 pages.
International Searching Authority Search Report, PCT/IB2011/051103, dated Jul. 8, 2011, 3 pages.
International Searching Authority Written Opinion, PCT/IB2010/055481, dated Apr. 7, 2011, 6 pages.
International Searching Authority Written Opinion, PCT/IB2011/051103, dated Jul. 8, 2011, 6 pages.
International Written Opinion corresponding to International Application No. PCT/CA2004/001742, Canadian Patent Office, dated Feb. 21, 2005 (5 pages).
International Written Opinion corresponding to International Application No. PCT/IB2011/055135, Canadian Patent Office, dated Apr. 16, 2012 (5 pages).
International Written Opinion for Application No. PCT/IB2010/055486, dated Apr. 19, 2011, 8 pages.
International Written Opinion for International Application No. PCT/CA2009/000501 dated Jul. 30, 2009 (6 pages).
International Written Opinion dated Mar. 21, 2006 corresponding to International Patent Application No. PCT/CA2005/001897 (4 pages).
International Written Opinion of the International Searching Authority corresponding to International Application No. PCT/IB2011/050502, dated Jun. 27, 2011 (7 pages).

(56) References Cited

OTHER PUBLICATIONS

International Written Opinion of the International Searching Authority corresponding to International Application No. PCT/IB2010/055541, dated May 26, 2011; 6 pages.
International Written Opinion, PCT/IB2012/052372, dated Sep. 12, 2012 (6 pages).
Jafarabadiashtiani et al.: "A New Driving Method for a-Si AMOLED Displays Based on Voltage Feedback"; dated 2005 (4 pages).
Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
Kanicki, J., et al. "Amorphous Silicon Thin-Film Transistors Based Active-Matrix Organic Light-Emitting Displays." Asia Display: International Display Workshops, Sep. 2001 (pp. 315-318).
Karim, K. S., et al. "Amorphous Silicon Active Pixel Sensor Readout Circuit for Digital Imaging." IEEE: Transactions on Electron Devices. vol. 50, No. 1, Jan. 2003 (pp. 200-208).
Lee et al.: "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Ma E Y et al.: "organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Mendes E., et al. "A High Resolution Switch-Current Memory Base Cell." IEEE: Circuits and Systems. vol. 2, Aug. 1999 (pp. 718-721).
Nathan A. et al., "Thin Film imaging technology on glass and plastic" ICM 2000, proceedings of the 12 international conference on microelectronics, dated Oct. 31, 2001 (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for active Matrix Organic Light Emitting Diode Displays,"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010. (8 pages).
Office Action in Japanese patent application No. JP2007-545796 dated Sep. 5, 2011. (8 pages).
Partial European Search Report dated Mar. 20, 2012 which issued in corresponding European Patent Application No. EP 11191641.7 (8 pages).
Partial European Search Report dated Sep. 22, 2011 corresponding to European Patent Application No. EP 11168677.0 (5 pages).
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy"; dated Sep. 2005 (9 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Spindler et al., System Considerations for RGBW OLED Displays, Journal of the SID 14/1, 2006, pp. 37-48.
Stewart M. et al., "polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
Extended European Search Report dated Aug. 6, 2013, issued in European Patent Application No. 11739485.8 (14 pages).
International Search Report corresponding to co-pending International Patent Application Serial No. PCT/IB2013/054251, Canadian Intellectual Property Office, dated Sep. 11, 2013; (4 pages).
International Written Opinion corresponding to co-pending International Patent Application Serial No. PCT/IB2013/054251, Canadian Intellectual Property Office, dated Sep. 11, 2013; (5 pages).
Singh, et al., "Current Conveyor: Novel Universal Active Block", Samriddhi, S-JPSET vol. I, Issue 1, 2010, pp. 41-48.
Extended European Search Report corresponding to co-pending European Patent Application Serial No. EP 11189176.8, European Patent Office, dated May 15, 2014; (12 pages).

* cited by examiner

SYSTEM AND METHOD FOR COMPENSATION OF NON-UNIFORMITIES IN LIGHT EMITTING DEVICE DISPLAYS

CROSS-REFERENCE TO RELATED APPLICATIONS

This application is a continuation of U.S. application Ser. No. 14/135,789, filed Dec. 20, 2013, which is a continuation-in-part of U.S. application Ser. No. 12/946,601, filed Nov. 15, 2010, which is a continuation-in-part of U.S. application Ser. No. 11/402,624, filed Apr. 12, 2006, now issued as U.S. Pat. No. 7,868,857, which claims priority to Canadian Patent Application No. 2,504,571, filed Apr. 12, 2005, each of which is incorporated herein by reference in its entirety.

FIELD OF THE INVENTION

The present invention relates to display technologies, more specifically a method and system for compensating for non-uniformities of elements in light emitting device displays.

BACKGROUND

Active-matrix organic light-emitting diode (AMOLED) displays are well known art. Amorphous silicon is, for example, a promising material for AMOLED displays, due to its low cost and vast installed infrastructure from thin film transistor liquid crystal display (TFTLCD) fabrication.

All AMOLED displays, regardless of backplane technology used, exhibit differences in luminance on a pixel to pixel basis, primarily as a result of process or construction inequalities, or from aging caused by operational use over time. Luminance non-uniformities in a display may also arise from natural differences in chemistry and performance from the OLED materials themselves. These non-uniformities must be managed by the AMOLED display electronics in order for the display device to attain commercially acceptable levels of performance for mass-market use.

FIG. 1 illustrates an operational flow of a conventional AMOLED display 10. Referring to FIG. 1, a video source 12 contains luminance data for each pixel and sends the luminance data in the form of digital data 14 to a digital data processor 16. The digital data processor 16 may perform some data manipulation functions, such as scaling the resolution or changing the color of the display. The digital data processor 16 sends digital data 18 to a data driver integrated circuit (IC) 20. The data driver IC 20 converts that digital data 18 into an analog voltage or current 22, which is sent to thin film transistors (TFTs) 26 in a pixel circuit 24. The TFTs 26 convert that voltage or current 22 into another current 28 which flows through an organic light-emitting diode (OLED) 30. The OLED 30 converts the current 28 into visible light 36. The OLED 30 has an OLED voltage 32, which is the voltage drop across the OLED. The OLED 30 also has an efficiency 34, which is a ratio of the amount of light emitted to the current through the OLED.

The digital data 14, analog voltage/current 22, current 28, and visible light 36 all contain the exact same information (i.e. luminance data). They are simply different formats of the initial luminance data that came from the video source 12. The desired operation of the system is for a given value of luminance data from the video source 12 to always result in the same value of the visible light 36.

However, there are several degradation factors which may cause errors on the visible light 36. With continued usage, the TFTs will output lower current 28 for the same input from the data driver IC 20. With continued usage, the OLED 30 will consume greater voltage 32 for the same input current. Because the TFT 26 is not a perfect current source, this will actually reduce the input current 28 slightly. With continued usage, the OLED 30 will lose efficiency 34, and emit less visible light for the same current.

Due to these degradation factors, the visible light output 36 will be less over time, even with the same luminance data being sent from the video source 12. Depending on the usage of the display, different pixels may have different amounts of degradation.

Therefore, there will be an ever-increasing error between the required brightness of some pixels as specified by the luminance data in the video source 12, and the actual brightness of the pixels. The result is that the decreased image will not show properly on the display.

One way to compensate for these problems is to use a feedback loop. FIG. 2 illustrates an operational flow of a conventional AMOLED display 40 that includes the feedback loop. Referring to FIG. 2, a light detector 42 is employed to directly measure the visible light 36. The visible light 36 is converted into a measured signal 44 by the light detector 42. A signal converter 46 converts the measured visible light signal 44 into a feedback signal 48. The signal converter 46 may be an analog-to-digital converter, a digital-to-analog converter, a microcontroller, a transistor, or another circuit or device. The feedback signal 48 is used to modify the luminance data at some point along its path, such as an existing component (e.g. 12, 16, 20, 26, 30), a signal line between components (e.g. 14, 18, 22, 28, 36), or combinations thereof.

Some modifications to existing components, and/or additional circuits may be required to allow the luminance data to be modified based on the feedback signal 48 from the signal converter 46. If the visible light 36 is lower than the desired luminance from video source 12, the luminance signal may be increased to compensate for the degradation of the TFT 26 or the OLED 30. This results in that the visible light 36 will be constant regardless of the degradation. This compensation scheme is often known as Optical Feedback (OFB). However, in the system of FIG. 2, the light detector 42 must be integrated onto a display, usually within each pixel and coupled to the pixel circuitry. Not considering the inevitable issues of yield when integrating a light detector into each pixel, it is desirable to have a light detector which does not degrade itself, however such light detectors are costly to implement, and not compatible with currently installed TFT-LCD fabrication infrastructure.

Therefore, there is a need to provide a method and system which can compensate for non-uniformities in displays without measuring a light signal.

AMOLED displays are conventionally operated according to digital data from a video source. The OLEDs within the display can be programmed to emit light with luminance according to a programming voltage or a programming current. The programming current or programming voltage are conventionally set by a display driver that takes digital data as input and has an analog output for sending the programming current or programming voltage to pixel circuits. The pixel circuits are configured to drive current through OLEDs based on the programming current or programming voltage.

SUMMARY

In accordance with an aspect of the present invention there is provided a display degradation compensation system for adjusting the operating conditions for pixels in an OLED display to compensate for non-uniformity or aging of the display. The system includes a controller programmed to set an initial value for at least one of peak luminance and an operating condition, calculate compensation values for the pixels in the display, determine the number of pixels having compensation values larger than a predetermined threshold compensation value, and if the determined number of pixels having compensation values larger than said predetermined threshold value is greater than a predetermined threshold number, adjust the set value until said determined number of pixels is less than said predetermined threshold number.

In accordance with a further aspect of the present invention there is provided a method of compensating non-uniformities in a light emitting device display having a plurality of pixels, including the steps of: estimating a degradation of the first pixel circuit based on measurement data read from a part of the first pixel circuit, and correcting pixel data applied to the first or a second pixel circuit based on the estimation of the degradation of the first pixel circuit.

The present disclosure provides a method of maintaining uniform luminosity of an AMOLED display. The AMOLED display includes an array of pixels having light emitting devices. The light emitting devices are configured to emit light according to digital input from a video source. The video source includes digital data corresponding to a desired luminance of each pixel in the AMOLED display. Over time, aspects within the light emitting devices and their associated driving circuits degrade and require compensation to continue to emit light with the same luminance for a given digital input.

Degradation of the pixels in the light emitting display are compensated by incrementing the digital inputs of the pixels according to a measured or estimated degradation of the pixels. To allow for compensation to occur, the digital input is compressed to a range of values less than an available range. Compressing the digital input is carried out according to a compression factor, which is a number less than one. In an implementation of the present disclosure, the digital inputs are multiplied by the compression factor, which compresses the digital input to a range less than the available range. The remaining portion of the digital range can be used to provide compensation to degraded pixels based on measured or estimated degradation of the pixels. The present disclosure provides methods for setting and adjusting the compression factor to statically or dynamically adjust the compression factor and provide compensation to the display by incrementing the digital signals before the signals are sent to the driving circuits.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

These and other features of the invention will become more apparent from the following description in which reference is made to the appended drawings.

Figure 1:
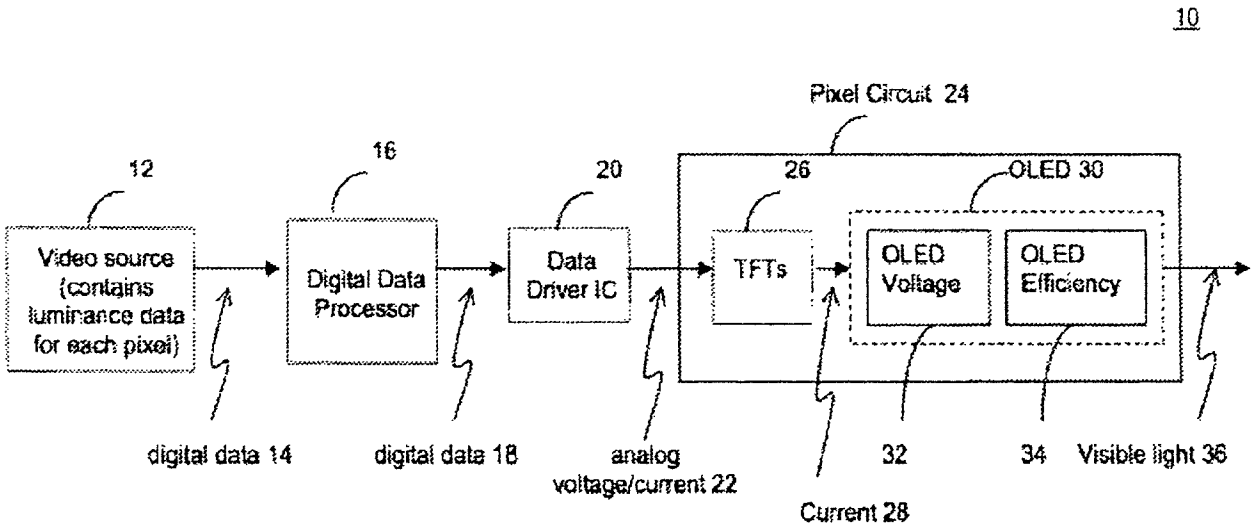
FIG.1 Prior Art
FIG. 1 illustrates a conventional AMOLED system.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Embodiments of the present invention are described using an AMOLED display which includes a pixel circuit having TFTs and an OLED. However, the transistors in the pixel circuit may be fabricated using amorphous silicon, nano/micro crystalline silicon, poly silicon, organic semiconductors technologies (e.g. organic TFT), NMOS technology, CMOS technology (e.g. MOSFET), or combinations thereof. The transistors may be a p-type transistor or n-type transistor. The pixel circuit may include a light emitting device other than OLED. In the description below, "pixel" and "pixel circuit" may be used interchangeably.

Figure 3:
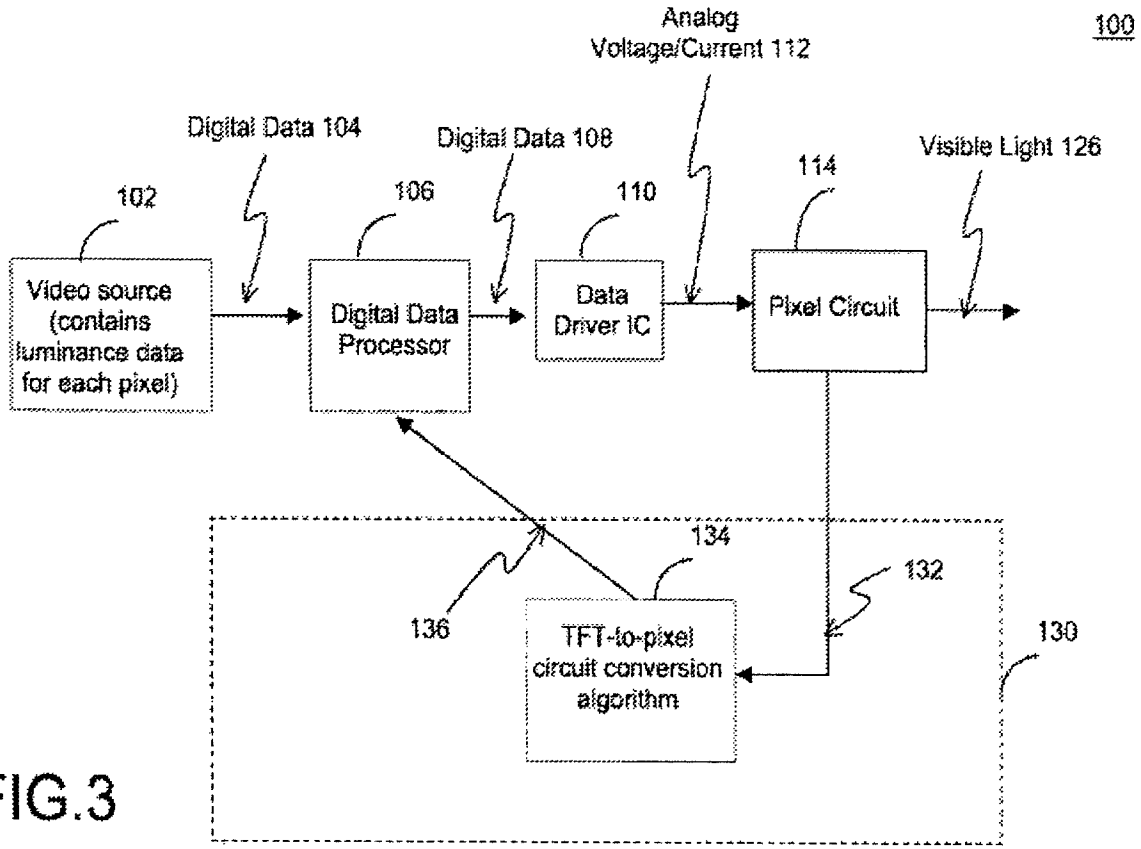
FIG. 3 illustrates a light emitting display system to which a compensation scheme in accordance with an embodiment of the present invention is applied.

FIG. 3 illustrates the operation of a light emitting display system 100 to which a compensation scheme in accordance with an embodiment of the present invention is applied. A video source 102 contains luminance data for each pixel and sends the luminance data in the form of digital data 104 to a digital data processor 106. The digital data processor 106 may perform some data manipulation functions, such as scaling the resolution or changing the color of the display. The digital data processor 106 sends digital data 108 to a data driver IC 110. The data driver IC 110 converts that digital data 108 into an analog voltage or current 112. The analog voltage or current 112 is applied to a pixel circuit 114. The pixel circuit 114 includes TFTs and an OLED. The pixel circuit 114 outputs a visible light 126 based on the analog voltage or current 112.

Figure 2:
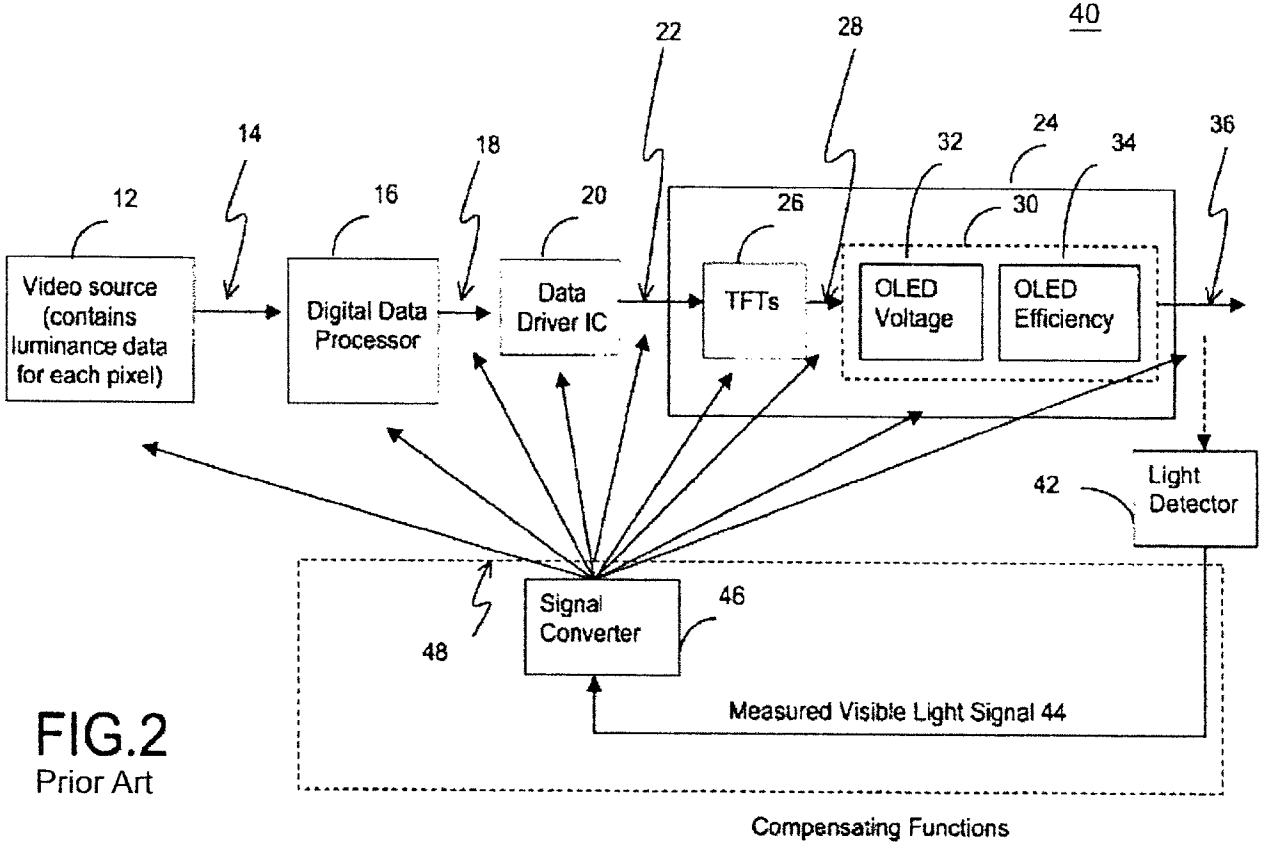
FIG.2 Prior Art
FIG. 2 illustrates a conventional AMOLED system that includes a light detector and a feedback scheme that uses the signal from the light detector.

In FIG. 3, one pixel circuit is shown as an example. However, the light emitting display system 100 includes a plurality of pixel circuits. The video source 102 may be similar to the video source 12 of FIGS. 1 and 2. The data driver IC 110 may be similar to the data driver IC 20 of FIGS. 1 and 2.

A compensation functions module 130 is provided to the display. The compensation functions module 130 includes a module 134 for implementing an algorithm (referred to as TFT-to-pixel circuit conversion algorithm) on measurement 132 from the pixel circuit 114 (referred to as degradation data, measured degradation data, measured TFT degradation data, or measured TFT and OLED degradation data), and outputs calculated pixel circuit degradation data 136. It is noted that in the description below, "TFT-to-pixel circuit conversion algorithm module" and "TFT-to-pixel circuit conversion algorithm" may be used interchangeably.

The degradation data 132 is electrical data which represents how much a part of the pixel circuit 114 has been degraded. The data measured from the pixel circuit 114 may represent, for example, one or more characteristics of a part of the pixel circuit 114.

The degradation data 132 is measured from, for example, one or more thin-film-transistors (TFTs), an organic light emitting diode (OLED) device, or a combination thereof. It is noted that the transistors of the pixel circuit 114 are not limited to TFTs, and the light emitting device of the pixel circuit 114 is not limited to an OLED. The measured degradation data 132 may be digital or analog data. The system 100 provides compensation data based on measurement from a part of the pixel circuit (e.g. TFT) to compensate for non-uniformities in the display. The non-uniformities may include brightness non-uniformity, color non-uniformity, or a combination thereof. Factors for causing such non-uniformities may include, but are not limited to, process or construction inequalities in the display, aging of pixels, etc.

The degradation data 132 may be measured at a regular timing or a dynamically regulated timing. The calculated pixel circuit degradation data 136 may be compensation data to correct non-uniformities in the display. The calculated pixel circuit degradation data 136 may include any parameters to produce the compensation data. The compensation data may be used at a regular timing (e.g. each frame, regular interval, etc.) or dynamically regulated timing. The measured data, compensation data, or a combination thereof may be stored in a memory (e.g. 142 of FIG. 8).

The TFT-to-pixel circuit conversion algorithm module 134 or the combination of the TFT-to-pixel circuit conversion algorithm module 134 and the digital data processor 106 estimates the degradation of the entire pixel circuit based on the measured degradation data 132. Based on this estimation, the entire degradation of the pixel circuit 114 is compensated by adjusting, at the digital data processor 106, the luminance data (digital data 104) applied to a certain pixel circuit(s).

The system 100 may modify or adjust luminance data 104 applied to a degraded pixel circuit or non-degraded pixel circuit. For example, if a constant value of visible light 126 is desired, the digital data processor 106 increases the luminance data for a pixel that is highly degraded, thereby compensating for the degradation.

In FIG. 3, the TFT-to-pixel circuit conversion algorithm module 134 is provided separately from the digital data processor 106. However, the TFT-to-pixel circuit conversion algorithm module 134 may be integrated into the digital data processor 106.

Figure 4:
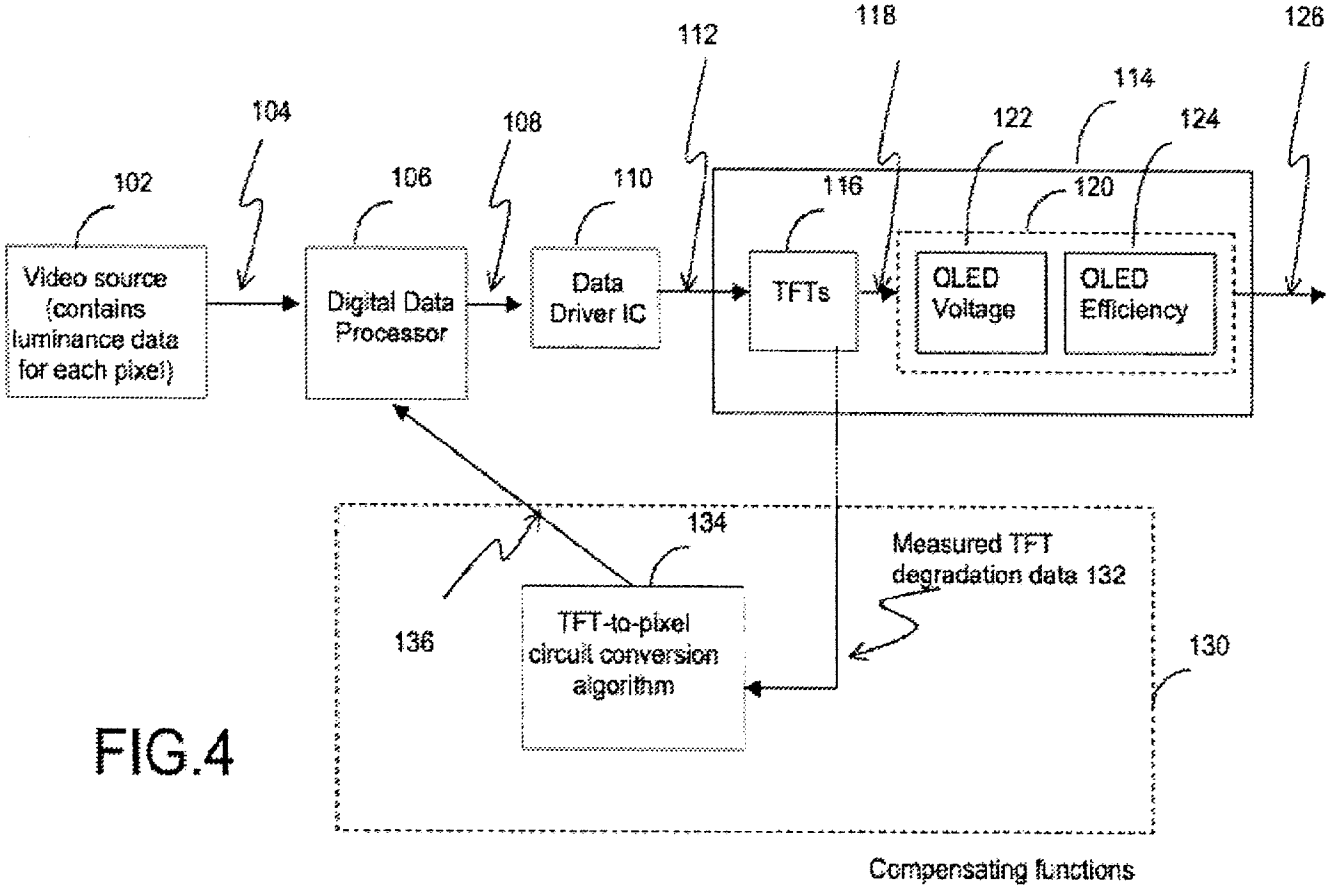
FIG. 4 illustrates an example of the light emitting display system of FIG. 3.

FIG. 4 illustrates an example of the system 100 of FIG. 3. The pixel circuit 114 of FIG. 4 includes TFTs 116 and OLED 120. The analog voltage or current 112 is provided to the TFTs 116. The TFTs 116 convert that voltage or current 112 into another current 118 which flows through the OLED 120. The OLED 120 converts the current 118 into the visible light 126. The OLED 120 has an OLED voltage 122, which is the voltage drop across the OLED. The OLED 120 also has an efficiency 134, which is a ratio of the amount of light emitted to the current through the OLED 120.

The system 100 of FIG. 4 measures the degradation of the TFTs only. The degradation of the TFTs 116 and the OLED 120 are usage-dependent, and the TFTs 116 and the OLED 120 are always linked in the pixel circuit 114. Whenever the TFT 116 is stressed, the OLED 120 is also stressed. Therefore, there is a predictable relationship between the degradation of the TFTs 116, and the degradation of the pixel circuit 114 as a whole. The TFT-to-pixel circuit conversion algorithm module 134 or the combination of the TFT-to-pixel circuit conversion algorithm module 134 and the digital data processor 106 estimates the degradation of the entire pixel circuit based on the TFT degradation only. An embodiment of the present invention may also be applied to systems that monitor both TFT and OLED degradation independently.

The pixel circuit 114 has a component that can be measured. The measurement obtained from the pixel circuit 114 is in some way related to the pixel circuit's degradation.

Figure 5:
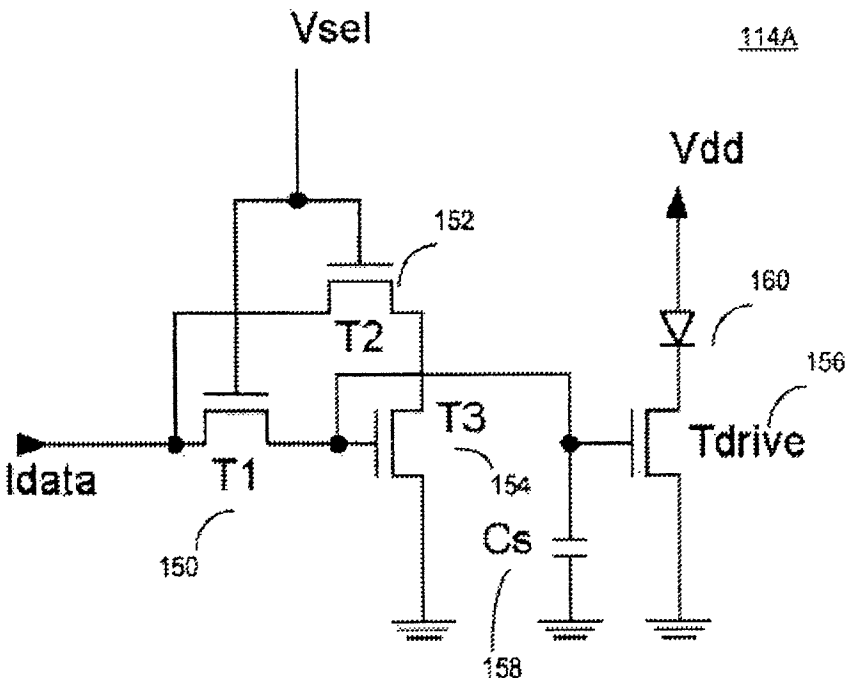
FIG. 5 illustrates an example of a pixel circuit of FIG. 5.

FIG. 5 illustrates an example of the pixel circuit 114 of FIG. 4. The pixel circuit 114 of FIG. 5 is a 4-T pixel circuit. The pixel circuit 114A includes a switching circuit having TFTs 150 and 152, a reference TFT 154, a dive TFT 156, a capacitor 158, and an OLED 160.

The gate of the switch TFT 150 and the gate of the feedback TFT 152 are connected to a select line Vsel. The first terminal of the switch TFT 154 and the first terminal of the feedback TFT 152 are connected to a data line Idata. The second terminal of the switch TFT 150 is connected to the gate of the reference TFT 154 and the gate of the drive TFT 156. The second terminal of the feedback TFT 152 is connected to the first terminal of the reference TFT 154. The capacitor 158 is connected between the gate of the drive TFT 156 and ground. The OLED 160 is connected between voltage supply Vdd and the drive TFT 156. The OLED 160 may also be connected between drive TFT 156 and ground in other systems (i.e. drain-connected format).

When programming the pixel circuit 114A, Vsel is high and a voltage or current is applied to the data line Idata. The data Idata initially flows through the TFT 150 and charges the capacitor 158. As the capacitor voltage rises, the TFT 154 begins to turn on and Idata starts to flow through the TFTs 152 and 154 to ground. The capacitor voltage stabilizes at the point when all of Idata flows through the TFTs 152 and 154. The current flowing through the TFT 154 is mirrored in the drive TFT 156.

In the pixel circuit 114A, by setting Vsel to high and putting a voltage on Idata, the current flowing into the Idata node can be measured. Alternately, by setting Vsel to high and putting a current on Idata, the voltage at the Idata node can be measured. As the TFTs degrade, the measured voltage (or current) will change, allowing a measure of the degradation to be recorded. In this pixel circuit, the analog voltage/current 112 shown in FIG. 4 is connected to the Idata node. The measurement of the voltage or current can occur anywhere along the connection between the data diver IC 110 and the TFTs 116.

In FIG. 4, the TFT-to-pixel circuit conversion algorithm is applied to the measurement 132 from the TFTs 116. However, current/voltage information read from various places other than TFTs 116 may be usable. For example, the OLED voltage 122 may be included with the measured TFT degradation data 132.

Figure 6:
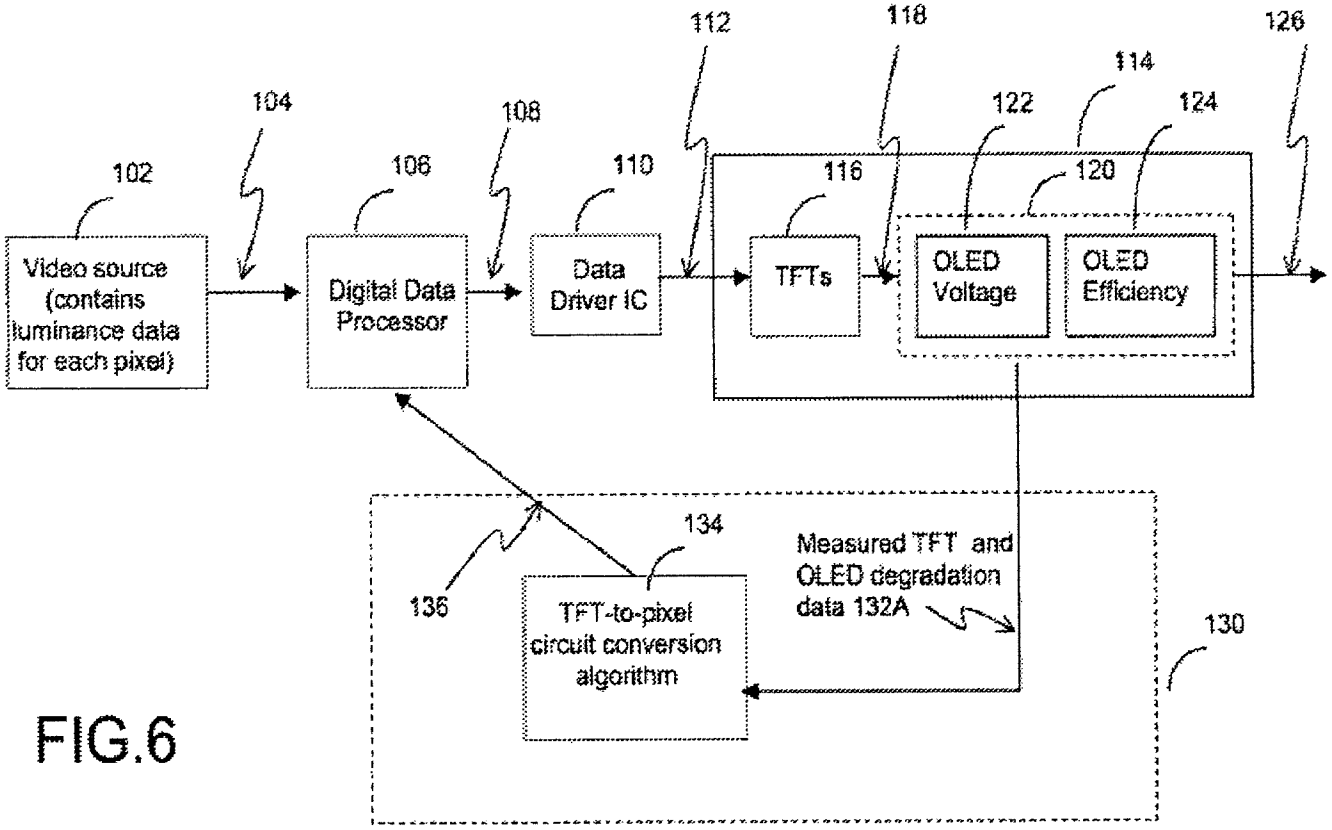
FIG. 6 illustrates a further example of the light emitting display system of FIG. 3.

FIG. 6 illustrates a further example of the system 100 of FIG. 3. The system 100 of FIG. 6 measures the OLED voltage 122. Thus, the measured data 132 is related to the TFT 116 and OLED 120 degradation ("measured TFT and OLED voltage degradation data 132A" in FIG. 6). The compensation functions module 130 of FIG. 6 implements the TFT-to-pixel circuit conversion algorithm 134 on the signal related to both the TFT degradation and OLED degradation. The TFT-to-pixel circuit conversion algorithm module 134 or the combination of the TFT-to-pixel circuit conversion algorithm module 134 and the digital data processor 106 estimates the degradation of the entire pixel circuit based on the TFT degradation and the OLED degradation. The TFT degradation and OLED degradation may be measured separately and independently.

Figure 7:
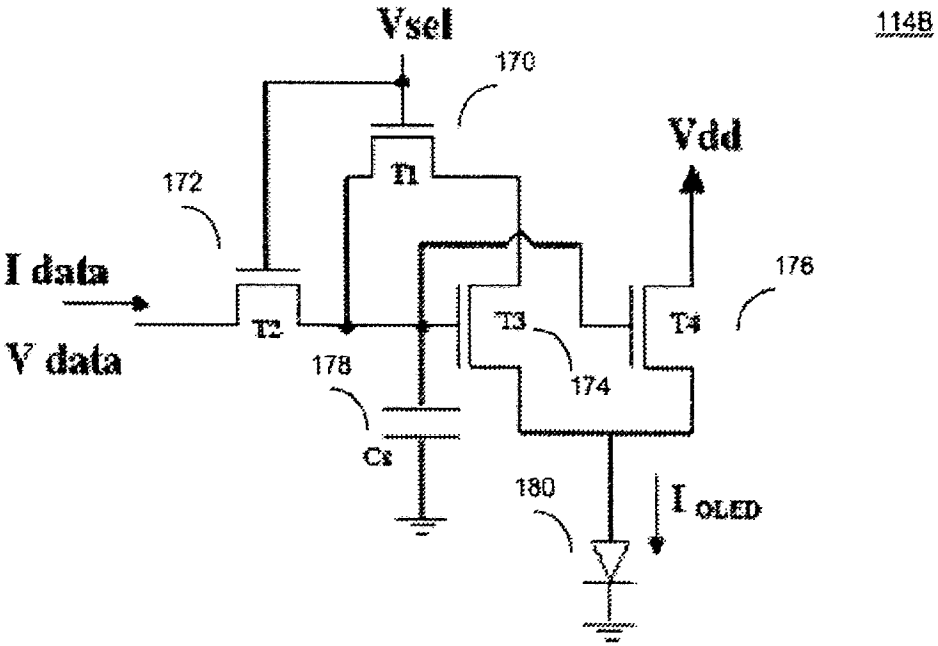
FIG. 7 illustrates an example of a pixel circuit of FIG. 6.

FIG. 7 illustrates an example of the pixel circuit 114 of FIG. 6. The pixel circuit 114B of FIG. 7 is a 4-T pixel circuit. The pixel circuit 114B includes a switching circuit having TFTs 170 and 172, a reference TFT 174, a drive TFT 176, a capacitor 178, and an OLED 180.

The gate of the switch TFT 170 and the gate of the switch TFT 172 are connected to a select line Vsel. The first terminal of the switch TFT 172 is connected to a data line Idata while the first terminal of the switch TFT 170 is connected to the second terminal of the switch TFT 172 which is connected to the gate of the reference TFT 174 and the gate of the dive TFT 176. The second terminal of the switch TFT 170 is connected to the first terminal of the reference TFT 174. The capacitor 178 is connected between the gate of the dive TFT 176 and ground. The first terminal of the dive TFT 176 is connected to voltage supply Vdd. The second terminal of the reference TFT 174 and the second terminal of the drive TFT 176 are connected to the OLED 180.

When programming the pixel circuit 114B, Vsel is high and a voltage or current is applied to the data line Idata. The data Idata initially flows through the TFT 172 and charges the capacitor 178. As the capacitor voltage rises, the TFT 174 begins to turn on and Idata starts to flow through the TFTs 170 and 174 and OLED 180 to ground. The capacitor voltage stabilizes at the point when all of Idata flows through the TFTs 170 and 174. The current flowing through the TFT 174 is mirrored in the drive TFT 176. In the pixel circuit 114B, by setting Vsel to high and putting a voltage on Idata, the current flowing into the Idata node can be measured. Alternately, by setting Vsel to high and putting a current on Idata, the voltage at the Idata node can be measured. As the TFTs degrade, the measured voltage (or current) will change, allowing a measure of the degradation to be recorded. It is noted that unlike the pixel circuit 114A of FIG. 5, the current now flows through the OLED 180. Therefore the measurement made at the Idata node is now partially related to the OLED voltage, which will degrade over time. In the pixel circuit 114B, the analog voltage/current 112 shown in FIG. 6 is connected to the Idata node. The measurement of the voltage or current can occur anywhere along the connection between the data driver IC 110 and the TFTs 116.

Referring to FIGS. 3, 4, and 6, the pixel circuit 114 may allow the current out of the TFTs 116 to be measured, and to be used as the measured TFT degradation data 132. The pixel circuit 114 may allow some part of the OLED efficiency to be measured, and to be used as the measured TFT degradation data 132. The pixel circuit 114 may also allow a node to be charged, and the measurement may be the time it takes for this node to discharge. The pixel circuit 114 may allow any parts of it to be electrically measured. Also, the discharge/charge level during a given time can be used for aging detection.

Figure 8:
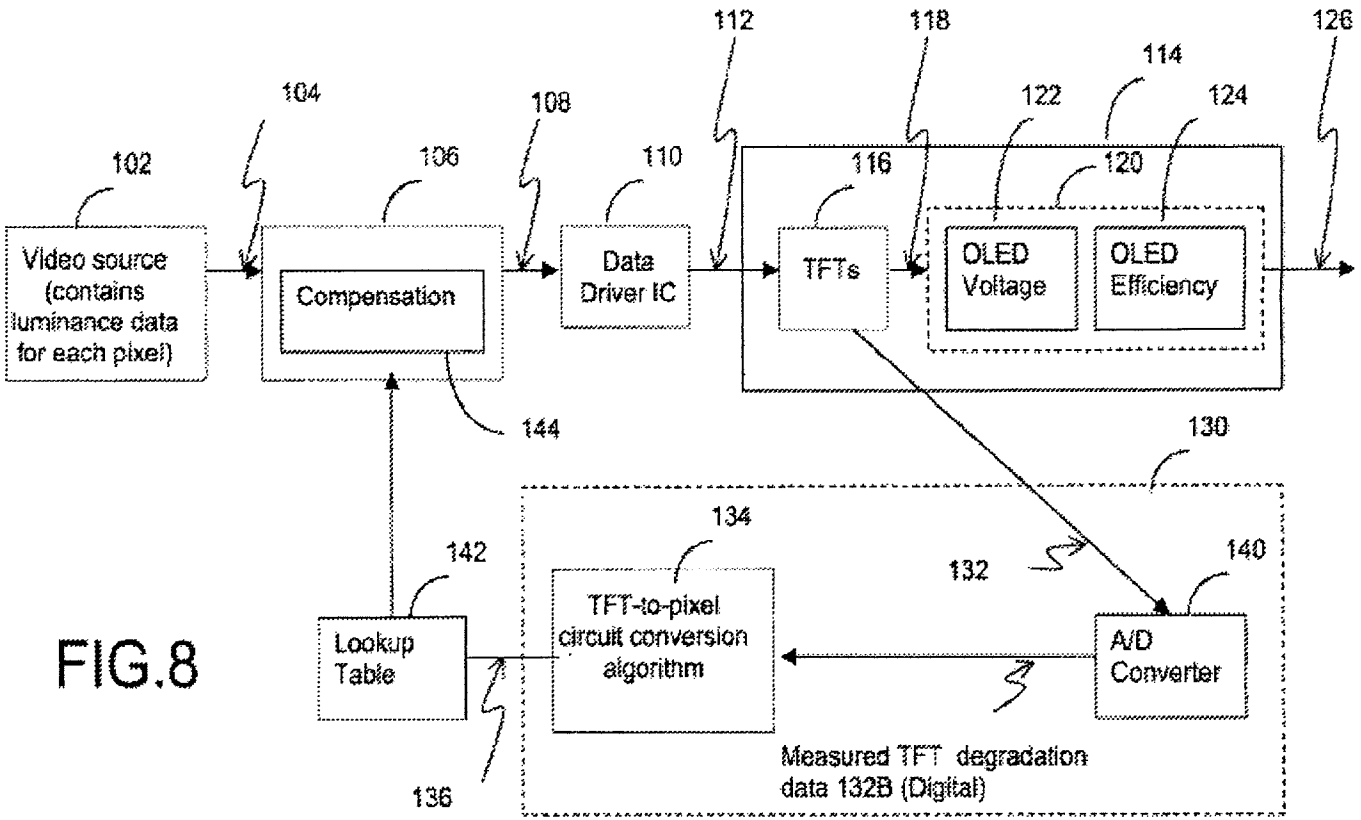
FIG. 8 illustrates an example of modules for the compensation scheme applied to the system of FIG. 4.

Referring to FIG. 8, an example of modules for the compensation scheme applied to the system of FIG. 4 is described. The compensation functions module 130 of FIG. 8 includes an analog/digital (A/D) converter 140. The A/D converter 140 converts the measured TFT degradation data 132 into digital measured TFT voltage/current 112 shown in FIG. 4 is connected to the Idata node. The measurement of the voltage or current can occur anywhere along the connection between the data driver IC 110 and the TFTs 116.

In FIG. 4, the TFT-to-pixel circuit conversion algorithm is applied to the measurement 132 from the TFTs 116. However, current/voltage information read from various places other than TFTs 116 may be usable. For example, the OLED voltage 122 may be included with the measured TFT degradation data 132.

FIG. 6 illustrates a further example of the system 100 of FIG. 3. The system 100 of the FIG. 6 measured the OLED voltage 122. Thus, the measured data 132 is related to the TFT 116 and OLED 120 degradation ("measured TFT and OLED voltage degradation data 132A" in FIG. 6). The compensation functions module 130 of FIG. 6 implements the TFT-to-pixel circuit conversion algorithm 134 on the signal related to both the TFT degradation and OLED degradation. The TFT-to-pixel circuit conversion algorithm module 134 or the combination of the TFT-to-pixel circuit conversion algorithm module 134 and the digital data processor 106 estimates the degradation fo the entire pixel circuit based on the TFT degradation and the OLED degradation. The TFT degradation and OLED degradation may be measured separately and independently.

FIG. 7 illustrates an example of the pixel circuit 114 of FIG. 6. The pixel circuit 114B of FIG. 7 is a 4-T pixel circuit. The pixel circuit 114B includes a switching circuit having TFTs 170 and 172, a reference TFT 174, a drive TFT 176, a capacitor 178, and an OLED 180.

The gate of the switch TFT 170 and the gate of the switch TFT 172 are connected to a select line Vsel. The first terminal of the switch TFT 172 is connected to a data line Idata while the first terminal of the switch TFT 170 is connected to the second terminal of the switch TFT 172, which is connected to the gate of the reference TFT 174 and the gate of the drive TFT 176. The second terminal of the switch TFT 170 is connected to the first terminal of the reference TFT 174. The capacitor 178 is connected between the gate of the drive TFT 176 and ground. The first terminal of the drive TFT 176 is connected to voltage supply Vdd. The second terminal of the reference TFT 174 and the second terminal of the drive TFT 176 are connected to the OLED 180.

When programming the pixel circuit 114B, Vsel is high and a voltage or current is applied to the data line Idata. The data Idata initially flows through the TFT 172 and charges the capacitor 178. As the capacitor voltage rises, the TFT 174 begins to turn on and Idata starts to flow through the TFTs 170 and 174 and OLED 180 to ground. The capacitor voltage stabilizes at the point when all of Idata flows through the TFTs 152 and 154. The current flowing through the TFT 154 is mirrored in the drive TFT 156. In the pixel circuit 114A, by setting Vsel to high and putting a voltage on Idata, the current flowing into the Idata node can be measured. Alternately, by setting Vsel to high and putting a current on Idata, the voltage at the Idata node can be measured. As the TFTs degrade, the measured voltage (or current) will change, allowing a measure of the degradation to be recorded. It is noted that unlike the pixel circuit 114A of FIG. 5, the current now flows through the OLED 180. Therefore the measurement made at the Idata node is now partially related to the OLED voltage, which will degrade over time. In the pixel circuit 114B, the analog voltage/current 112 shown in FIG. 6 is connected to the Idata node. The measurement of the voltage or current can occur anywhere along the connection between the data driver IC 110 and the TFTs 116.

Referring to FIGS. 3, 4, and 6, the pixel circuit 114 may allow the current out of the TFTs 116 to be measured, and to be used as the measured TFT degradation data 132. The pixel circuit 114 may allow some part of the OLED efficiency to be measured, and to be used as the measured TFT degradation data 132. The pixel circuit 114 may also allow a node to be charged, and the measurement may be the time it takes for this node to discharge. The pixel circuit 114 may allow any parts of it to be electrically measured. Also, the discharge/charge level during a given time can be used for aging detection.

Referring to FIG. 8, an example of modules for the compensation scheme applied to the system of FIG. 4 is described. The compensation functions module 130 of FIG. 8 includes an analog/digital (A/D) converter 140. The A/D converter 140 converts the measured TFT degradation data 132 into digital measured TFT degradation data 132B. The digital measured TFT degradation data 132B is converted into the calculated pixel circuit degradation data 136 at the TFT-to-pixel circuit conversion algorithm module 134. The calculated pixel circuit degradation data 136 is stored in a lookup table 142. Since measuring TFT degradation data from some pixel circuits may take a long time, the calculated pixel circuit degradation data 136 is stored in the lookup table 142 for use.

In FIG. 8, the TFT-to-pixel circuit conversion algorithm 134 is a digital algorithm. The digital TFT-to-pixel circuit conversion algorithm 134 may be implemented, for example, on a microprocessor, an FPGA, a DSP, or another device, but not limited to these examples. The lookup table 142 may be implemented using memory, such as SRAM or DRAM. This memory may be in another device, such as a microprocessor or FPGA, or may be an independent device.

The calculated pixel circuit degradation data 136 stored in the lookup table 142 is always available for the digital data processor 106. Thus, the TFT degradation data 132 for each pixel does not have to be measured every time the digital data processor 106 needs to use the data. The degradation data 132 may be measured infrequently (for example, once every 20 hours, or less). Using a dynamic time allocation for the degradation measurement is another case, more frequent extraction at the beginning and less frequent extraction after the aging gets saturated.

The digital data processor 106 may include a compensation module 144 for taking input luminance data for the pixel circuit 114 from the video source 102, and modifying it based on degradation data for that pixel circuit or other pixel circuit. In FIG. 8, the module 144 modifies luminance data using information from the lookup table 142.

It is noted that the configuration of FIG. 8 is applicable to the system of FIGS. 3 and 6. It is noted that the lookup table 142 is provided separately from the compensating functions module 130, however, it may be in the compensating functions module 130. It is noted that the lookup table 142 is provided separately from the digital data processor 106, however, it may be in the digital data processor 106.

Figure 9:
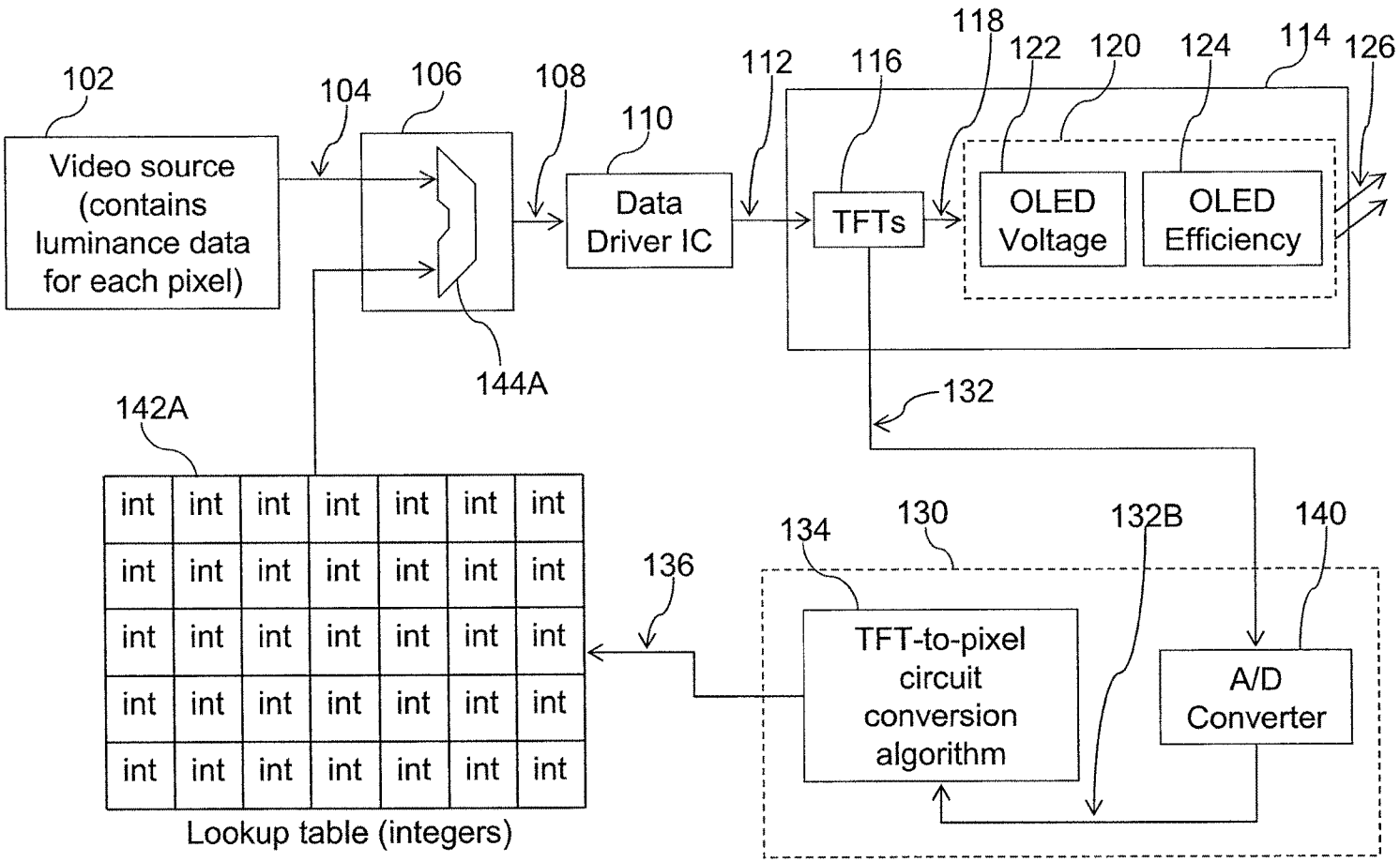
FIG. 9 illustrates an example of a lookup table and a compensation algorithm module of FIG. 7.

One example of the lookup table 142 and the module 144 of the digital data processor 106 is illustrated in FIG. 9. Referring to FIG. 9, the output of the TFT-to-pixel circuit conversion algorithm module 134 is an integer value. This integer is stored in a lookup table 142A (corresponding to 142 of FIG. 8). Its location in the lookup table 142A is related to the pixel's location on the AMOLED display. Its value is a number, and is added to the digital luminance data 104 to compensate for the degradation.

For example, digital luminance data may be represented to use 8-bits (256 values) for the brightness of a pixel. A value of 246 may represent maximum luminance for the pixel. A value of 128 may represent approximately 50% luminance. The value in the lookup table 142A may be the number that is added to the luminance data 104 to compensate for the degradation. Therefore, the compensation module (144 of FIG. 7) in the digital data processor 106 may be implemented by a digital adder 144A. It is noted that digital luminance data may be represented by any number of bits, depending on the driver IC used (for example, 6-bit, 8-bit, 10-bit, 14-bit, etc.).

Figure 10:
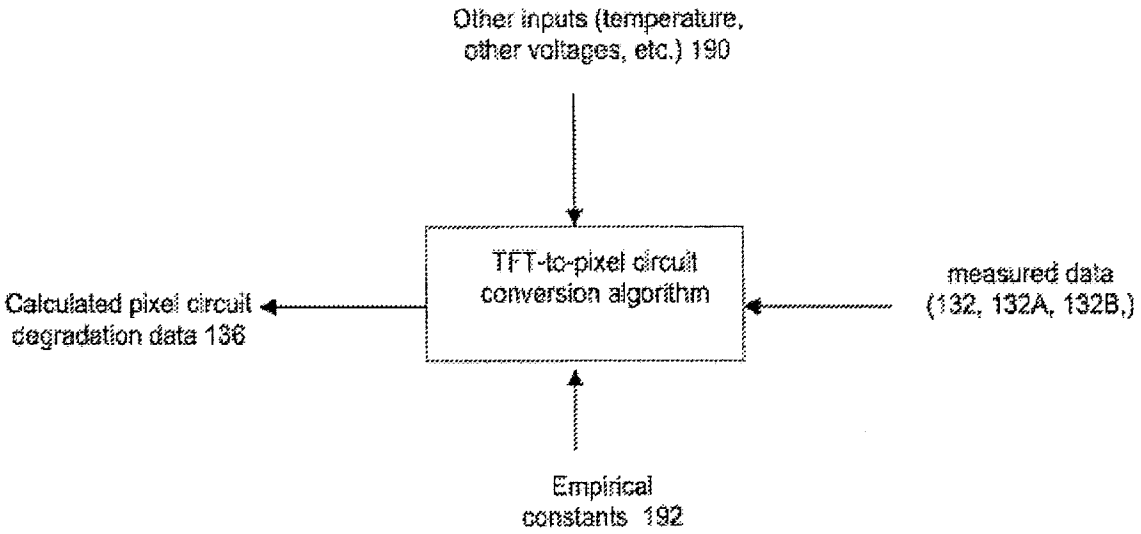
FIG. 10 illustrates an example of inputs to a TFT-to-pixel circuit conversion algorithm module.

In FIGS. 3, 4, 6, 8, and 9, the TFT-to-pixel circuit conversion algorithm module 134 has the measured TFT degradation data 132 or 132A as an input, and the calculated pixel circuit degradation data 136 as an output. However, there may be other inputs to the system to calculate compensation data as well, as shown in FIG. 10. FIG. 10 illustrates an example of inputs to the TFT-to-pixel circuit conversion algorithm module 134. In FIG. 10, the TFT-to-pixel circuit conversion algorithm module 134 processes the measured data (132 of FIGS. 3, 4, 8, and 9; 132A of FIG. 5;

132B of FIGS. 8 and 9) based on additional inputs 190 (e.g. temperature, other voltages, etc.), empirical constants 192, or combinations thereof.

The additional inputs 190 may include measured parameters such as a voltage reading from current-programming pixels and a current reading from voltage-programming pixels. These pixels may be different from a pixel circuit from which the measured signal is obtained. For example, a measurement is taken from a "pixel under test" and is used in combination with another measurement from a "reference pixel." As described below, in order to determine how to modify luminance data to a pixel, data from other pixels in the display may be used. The additional inputs 190 may include light measurements, such as measurement of an ambient light in a room. A discrete device or some kind of test structure around the periphery of the panel may be used to measure the ambient light. The additional inputs may include humidity measurements, temperature readings, mechanical stress readings, other environmental stress readings, and feedback from test structures on the panel It may also include empirical parameters 192, such as the brightness loss in the OLED due to decreasing efficiency ($\Delta L$), the shift in OLED voltage over time ($\Delta$Voled), dynamic effects of Vt shift, parameters related to TFT performance such as Vt, $\Delta$Vt, mobility ($\mu$), inter-pixel non-uniformity, DC bias voltages in the pixel circuit, changing gain of current-mirror based pixel circuits, short-term and long-term based shifts in pixel circuit performance, pixel-circuit operating voltage variation due to IR-drop and ground bounce.

Referring to FIGS. 8 and 9, the TFT-to-pixel-circuit conversion algorithm in the module 134 and the compensation algorithm 144 in the digital data processor 106 work together to convert the measured TFT degradation data 132 into a luminance correction factor. The luminance correction factor has information about how the luminance data for a given pixel is to be modified, to compensate for the degradation in the pixel.

In FIG. 9, the majority of this conversion is done by the TFT-to-pixel-circuit conversion algorithm module 134. It calculates the luminance correction values entirely, and the digital adder 144A in the digital data processor 106 simply adds the luminance correction values to the digital luminance data 104. However, the system 100 may be implemented such that the TFT-to-pixel circuit conversion algorithm module 134 calculates only the degradation values, and the digital data processor 106 calculates the luminance correction factor from that data. The TFT-to-pixel circuit conversion algorithm 134 may employ fuzzy logic, neural networks, or other algorithm structures to convert the degradation data into the luminance correction factor.

The value of the luminance correction factor may allow the visible light to remain constant, regardless of the degradation in the pixel circuit. The value of the luminance correction factor may allow the luminance of degraded pixels not to be altered at all; instead, the luminance of the non-degraded pixels to be decreased. In this case, the entire display may gradually lose luminance over time, however the uniformity may be high.

The calculation of a luminance correction factor may be implemented in accordance with a compensation of non-uniformity algorithm, such as a constant brightness algorithm, a decreasing brightness algorithm, or combinations thereof. The constant brightness algorithm and the decreasing brightness algorithm may be implemented on the TFT-to-pixel circuit conversion algorithm module (e.g. 134 of FIG. 3) or the digital data processor (e.g. 106 of FIG. 3). The constant brightness algorithm is provided for increasing brightness of degraded pixels so as to match nondegraded pixels. The decreasing brightness algorithm is provided for decreasing brightness of non-degraded pixels 244 so as to match degraded pixels. These algorithm may be implemented by the TFT-to-pixel circuit conversion algorithm module, the digital data processor (such as 144 of FIG. 8), or combinations thereof. It is noted that these algorithms are examples only, and the compensation of non-uniformity algorithm is not limited to these algorithms.

Referring to FIGS. 11A-11E, the experimental results of the compensation of non-uniformity algorithms are described in detail. Under the experiment, an AMOLED display includes a plurality of pixel circuits, and is driven by a system as shown in FIGS. 3, 4, 6, 8 and 9. It is noted that the circuitry to drive the AMOLED display is not shown in FIGS. 11A-11E.

Figure 11A:
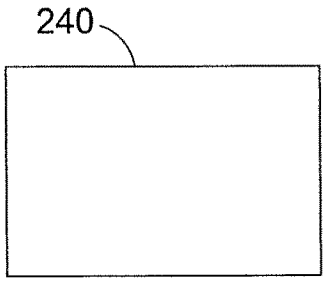
FIG. 11A illustrates an experimental result of a video source outputting equal luminance data for each pixel for a usage time of zero hours.

FIG. 11A schematically illustrates an AMOLED display 240 which starts operating (operation period t=0 hour). The video source (102 of FIGS. 3, 4, 7, 8 and 9) initially outputs maximum luminance data to each pixel. No pixels are degraded since the display 240 is new. The result is that all pixels output equal luminance and thus all pixels show uniform luminance.

Figure 11B:
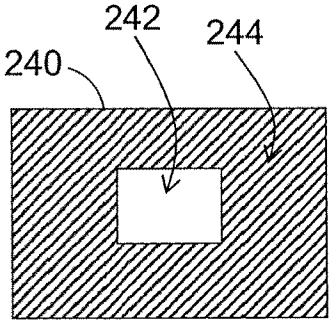
FIG. 11B illustrates an experimental result of a video source outputting maximum luminance data to some pixels and zero luminance data to other pixels for a usage of time of 1000 hours.

Next, the video source outputs maximum luminance data to some pixels in the middle of the display as shown in FIG. 11B. FIG. 11B schematically illustrates the AMOLED display 240 which has operated for a certain period where maximum luminance data is applied to pixels in the middle of the display. The video source outputs maximum luminance data to pixels 242, while it outputs minimum luminance data (e.g. zero luminance data) to pixels 244 around the outside of the pixels 242. It maintains this for a long period of time, for example 1000 hours. The result is that the pixels 242 at maximum luminance will have degraded, and the pixels 244 at zero luminance will have no degradation.

At 1000 hours, the video source outputs maximum luminance data to all pixels. The results are different depending on the compensation algorithm used, as shown in FIGS. 11C-11E.

Figure 11C:
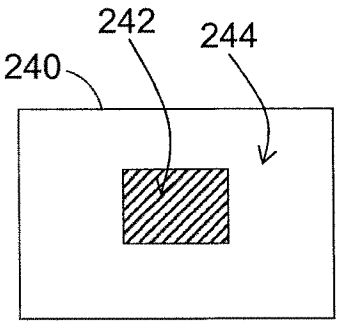
FIG. 11C illustrates an experimental result of a video source outputting equal luminance data for each pixel after some pixels received maximum luminance data and others pixels received zero luminance data for a usage time of 1000 hours when no compensation algorithm is applied.

FIG. 11C schematically illustrates the AMOLED display 240 to which no compensation algorithm is applied. As shown in FIG. 11C, if there was no compensation algorithm, the degraded pixels 242 would have a lower brightness than the non-degraded pixels 244.

Figure 11D:
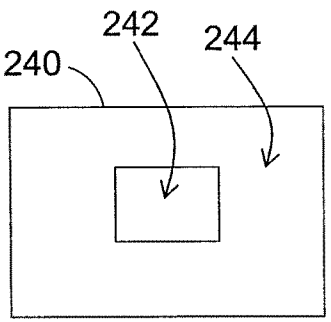
FIG. 11D illustrates an experimental result of a video source outputting equal luminance data for each pixel after some pixels received maximum luminance data and others pixels received zero luminance data for a usage time of 1000 hours when a constant brightness compensation algorithm is applied.

FIG. 11D schematically illustrates the AMOLED display 240 to which the constant brightness algorithm is applied. The constant brightness algorithm is implemented for increasing luminance data to degraded pixels, such that the luminance data of the degraded pixels 242 matches that of non-degraded pixels 244. For example, the increasing brightness algorithm provides increasing currents to the stressed pixels 242, and constant current to the unstressed pixels 244. Both degraded and non-degraded pixels have the same brightness. Thus, the display 240 is uniform. Differential aging is compensated, and brightness is maintained, however more current is required. Since the current to some pixels is being increased, this will cause the display to consume more current over time, and therefore more power over time because power consumption is related to the current consumption.

Figure 11E:
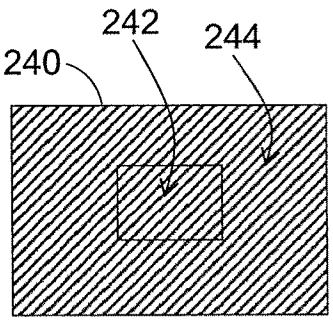
FIG. 11E illustrates an experimental result of a video source outputting equal luminance data for each pixel after some pixels received maximum luminance data and others pixels received zero luminance data for a usage time of 1000 hours when a decreasing brightness compensation algorithm is applied.

FIG. 11E schematically illustrates the AMOLED display 240 to which the decreasing brightness algorithm is applied. The decreasing brightness algorithm decreases luminance data to non-degraded pixels, such that the luminance data of the non-degraded pixels 244 match that of degraded pixels 242. For example, the decreasing brightness algorithm provides constant OLED current to the stressed pixels 242, while decreasing current to the unstressed pixels 244. Both degraded and non-degraded pixels have the same brightness. Thus, the display 240 is uniform. Differential aging is compensated, and it requires a lower Vsupply, however brightness decrease over time. Because this algorithm does not increase the current to any of the pixels, it will not result in increased power consumption.

Figure 12:
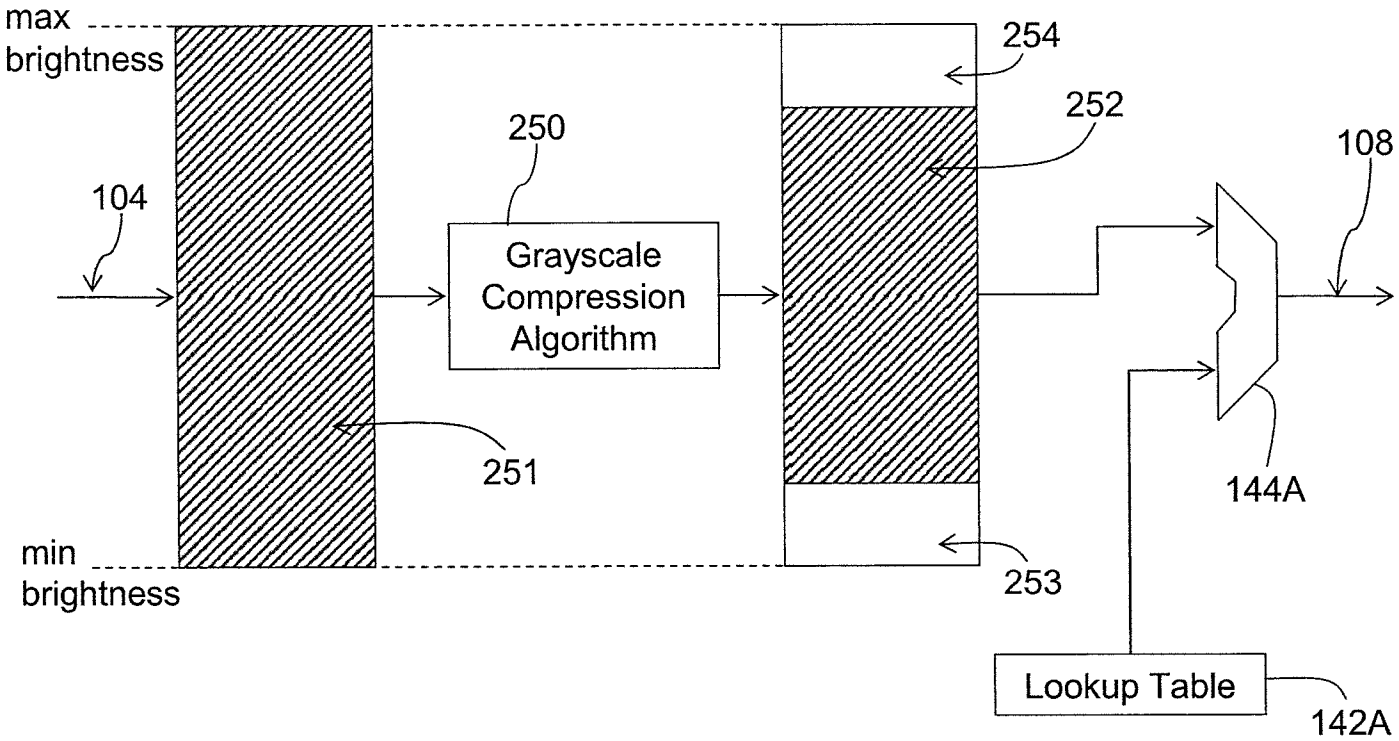
FIG. 12 illustrates an example of a grayscale compression algorithm.

Referring to FIG. 3, components, such as the video source 102 and the data driver IC 110, may use only 8-bits, or 256 discrete luminance values. Therefore if the video source 102 outputs maximum brightness (a luminance value of 255), there is no way to add any additional luminance, since the pixel is already at the maximum brightness supported by the components in the system. Likewise, if the video source 102 outputs minimum brightness (a luminance value of 0), there is no way to subtract any luminance. The digital data processor 106 may implement a grayscale compression algorithm to reserve some grayscales. FIG. 12 illustrates an implementation of the digital data processor 106 which includes a grayscale compression algorithm module 250. The grayscale compression algorithm 250 takes the video signal 104 represented by 256 luminance values (251), and transforms it to use less luminance values (252). For example, instead of minimum brightness represented by grayscale 0, minimum brightness may be represented by grayscale 50. Likewise, maximum brightness may be represented by grayscale 200. In this way, there are some grayscales reserved for future increase (254) and decrease (253). It is noted that the shift in grayscales does not reflect the actual expected shift in grayscales.

According to the embodiments of the present invention, the scheme of estimating (predicting) the degradation of the entire pixel circuit and generating a luminance correction factor ensures uniformities in the display. According to embodiments of the present invention, the aging of some components or entire circuit can be compensated, thereby ensuring uniformity of the display.

According to the embodiments of the present invention, the TFT-to-pixel circuit conversion algorithm allows for improved display parameters, for example, including constant brightness uniformity and color uniformity across the panel over time. Since the TFT-to-pixel circuit conversion algorithm takes in additional parameters, for example, temperature and ambient light, any changes in the display due to these additional parameters may be compensated for.

The TFT-to-Pixel circuit conversion algorithm module (134 of FIGS. 3, 4, 6, 8 and 9), the compensation module (144 of FIG. 8, 144A of FIG. 9, the compensation of non-uniformity algorithm, the constant brightness algorithm, the decreasing brightness algorithm and the grayscale compression algorithm may be implemented by any hardware, software or a combination of hardware and software having the above described functions. The software code, instructions and/or statements, either in its entirety or a part thereof, may be stored in a computer readable memory. Further, a computer data signal representing the software code, instructions and/or statements, which may be embedded in a carrier wave may be transmitted via a communication network. Such a computer readable memory and a computer data signal and/or its carrier are also within the scope of the present invention, as well as the hardware, software and the combination thereof.

Referring again to FIG. 3, which illustrates the operation of the light emitting display system 100 by applying a compensation algorithm to digital data 104. In particular, FIG. 3 illustrates the operation of a pixel in an active matrix organic light emitting diode (AMOLED) display. The display system 100 includes an array of pixels. The video source 102 includes luminance input data for the pixels. The luminance data is sent in the form of digital input data 104 to the digital data processor 106. The digital input data 104 can be eight-bit data represented as integer values existing between 0 and 255, with greater integer values corresponding to higher luminance levels. The digital data processor 106 can optionally manipulate the digital input data 104 by, for example, scaling the resolution of the video source 102 to a native screen resolution, adjusting the color balance, or applying a gamma correction to the video source 102. The digital data processor 106 can also apply degradation corrections to the digital input data 104 based on degradation data 136. Following the manipulations, the digital data processor 106 sends the resulting digital data 108 to the data driver integrated circuit (IC) 110. The data driver IC 110 converts the digital data 108 into the analog voltage or current output 112. The data driver IC 110 can be implemented, for example, as a module including a digital to analog converter. The analog voltage or current 112 is provided to the pixel circuit 114. The pixel circuit 114 can include an organic light emitting diode (OLED) and thin film transistors (TFTs). One of the TFTs in the pixel circuit 114 can be a drive TFT that applies a drive current to the OLED. The OLED emits visible light 126 responsive to the drive current flowing to the OLED. The visible light 126 is emitted with a luminance related to the amount of current flowing to the OLED through the drive TFT.

In a configuration where the analog voltage or current 112 is a programming voltage, the drive TFT within the pixel circuit 114 can supply the OLED according to the analog voltage or current 112 by, for example, biasing the gate of the drive TFT with the programming voltage. The pixel circuit 114 can also operate where the analog voltage or current 112 is a programming current applied to each pixel rather than a programming voltage. A display system 100 utilizing programming currents can use current mirrors in each pixel circuit 114 to apply a drive current to the OLED through the drive TFT according to the programming current applied to each pixel.

The luminance of the emitted visible light 126 is affected by aspects within the pixel circuit 114 including the gradual degradation of hardware within the pixel circuit 114. The drive TFT has a threshold voltage, and the threshold voltage can change over time due to aging and stressing of the drive TFT. The luminance of the emitted visible light 126 can be influenced by the threshold voltage of the drive TFT, the voltage drop across the OLED, and the efficiency of the OLED. The efficiency of the OLED is a ratio of the luminance of the emitted visible light 126 to the drive current flowing through the OLED. Furthermore, the degradation can generally be non-uniform across the display system 100 due to, for example, manufacturing tolerances of the drive TFTs and OLEDs and differential aging of pixels in the display system 100. Non-uniformities in the display 100 are generally referred to as display mura or defects. In a display 100 with an array of OLEDs having uniform light emitting efficiency and threshold voltages driven by TFTs having uniform gate threshold voltages, the luminance of the display will be uniform when all the pixels in the display are programmed with the same analog voltage or current 112. However, as the OLEDs and TFTs in each pixel age and the degradation characteristics change, the luminance of the display ceases to be uniform when programmed the same.

The degradation can be compensated for by increasing the amount of drive current sent through the OLED in the pixel circuit 114. According to an implementation of the present disclosure, compensation for the degradation of the display 100 can be carried out by adjusting the digital data 108 output from the digital data processor 106. The digital data processor 106 receives the degradation data 136 from the compensation module 130. The compensation module 130 receives degradation data 132 based on measurements of parameters within the pixel circuit 114. Alternatively, the degradation data 132 sent to the compensation module 130 can be based on estimates of expected performance of the hardware aspects within the pixel circuit 114. The compensation module 130 includes the module 134 for implementing the algorithm 134, such as the TFT-to-pixel circuit conversion algorithm. The degradation data 132 can be electrical data that represents how much a hardware aspect of the pixel circuit 114 has been degraded. The degradation data 132 measured or estimated from the pixel circuit 114 can represent one or more characteristics of the pixel circuit 114.

In a configuration where the analog voltage or current 112 is a programming voltage, the programming voltage is generally determined by the digital input data 104, which is converted to a voltage in the data driver IC 110. The present disclosure provides a method of compensating for non-uniform characteristics in each pixel circuit 114 that affect the luminance of the emitted visible light 126 from each pixel. Compensation is performed by adjusting the digital input data 104 in the digital data processor 106 before the digital data 108 is passed to the data driver IC 110.

Figure 13:
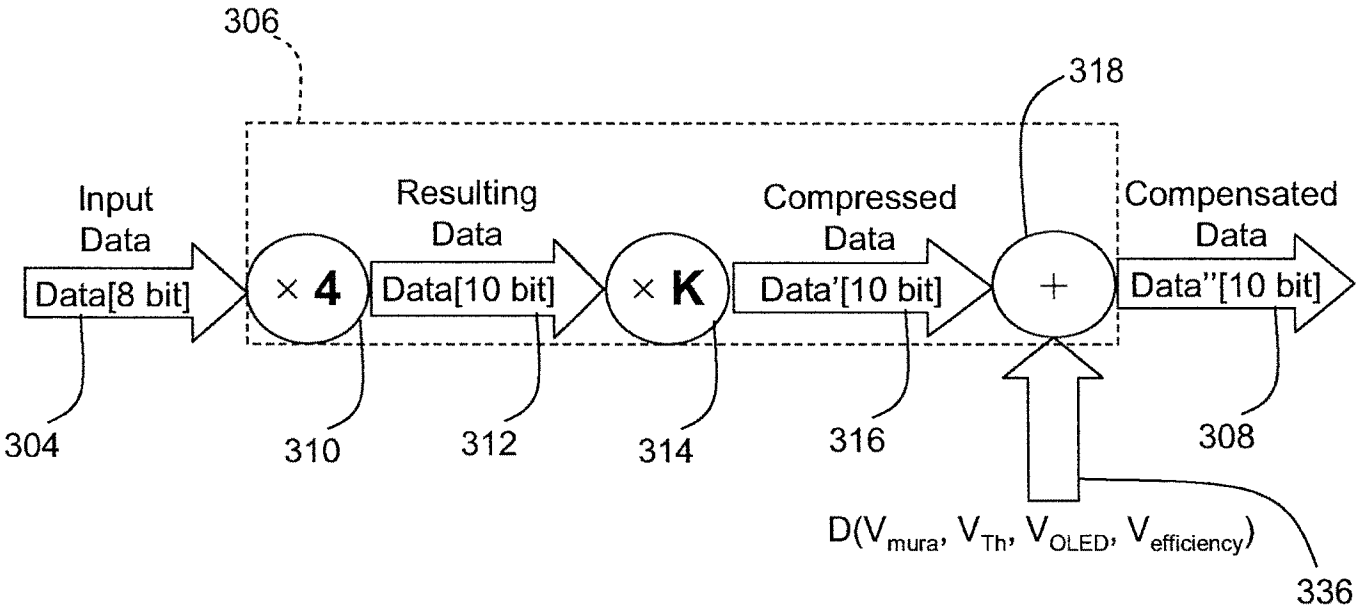
FIG. 13 is a data flow chart showing the compression and compensation of luminosity input data used to drive an AMOLED display.

FIG. 13 is a data flow chart showing the compression and compensation of luminosity input data 304 used to drive an AMOLED display. The data flow chart shown in FIG. 13 includes a digital data processor block 306 that can be considered an implementation of the digital data processor 106 shown in FIG. 3. Referring again to FIG. 13, a video source provides the luminosity input data 304. The input data 304 is a set of eight-bit integer values. The input data 304 includes integer values that exist between 0 and 255, with the values representing 256 possible programmable luminosity values of the pixels in the AMOLED display. For example, 255 can correspond to a pixel programmed with maximum luminance, and 127 can correspond to a pixel programmed with roughly half the maximum luminance. The input data 304 is similar to the digital input data 104 shown in FIG. 3. Referring again to FIG. 13, the input data 304 is sent to the digital data processor block 304. In the digital data processor block 304, the input data 304 is multiplied by four (310) in order to translate the eight-bit input data 304 to ten-bit resulting data 312. Following the multiplication by four (310), the resulting data 312 is a set of ten-bit integers existing between 0 and 1020.

By translating the eight-bit input data 304 to the ten-bit resulting data 312, the resulting data 312 can be manipulated for compensation of luminance degradation with finer steps than can be applied to the eight-bit input data 304. The ten-bit resulting data 312 can also be more accurately translated to programming voltages according to a gamma correction. The gamma correction is a non-linear, power law correction as is appreciated in the art of display technology. Applying the gamma correction to the input data can be advantageous, for example, to account for the logarithmic nature of the perception of luminosity in the human eye. According to an aspect of the present disclosure, multiplying the input data 304 by four (310) translates the input data 304 into a higher quantized domain. While the present disclosure includes multiplying by four (310), in an implementation the input data 304 can be multiplied by any number to translate the input data 310 into a higher quantized domain. The translation can advantageously utilize multiplication by a power of two, such as four, but the present disclosure is not so limited. Additionally, the present disclosure can be implemented without translating the input data 304 to a higher quantized domain.

The resulting data 312 is multiplied by a compression factor, K (314). The compression factor, K, is a number with a value less than one. Multiplying the resulting data 312 by K (314) allows for scaling the ten-bit resulting data 312 into compressed data 316. The compressed data 316 is a set of ten-bit integers having values ranging from 0 to the product of K and 1020. Next, the compressed data 316 is compensated for degradations in the display hardware (318). The compressed data 316 is compensated by adding additional data increments to the integers corresponding to the luminance of each pixel (318). The compensation for degradation is performed according to degradation data 336 that is sent to the digital data processor block 306. The degradation data 336 is digital data representing an amount of compensation to be applied to the compressed data 316 within the digital data processor block 306 according to degradations in the display hardware corresponding to each pixel. Following the compensation for degradations (318), compensated data 308 is output. The compensated data 208 is a set of ten-bit integer values with possible values between 0 and 1023. The compensated data 308 is similar in some respects to the digital data 108 output from the digital data processor 106 in FIG. 3. Referring again to FIG. 13, the compensated data 308 is supplied to a display driver, such as a display driver incorporating a digital to analog converter, to create programming voltages for pixels in the AMOLED display.

The degradations in the display hardware can be from mura defects (non-uniformities), from the OLED voltage drop, from the voltage threshold of the drive TFT, and from changes in the OLED light emitting efficiency. The degradations in the display hardware each generally correspond to an additional increment of voltage that is applied to the pixel circuit in order to compensate for the degradations. For a particular pixel, the increments of additional voltage necessary to compensate for the hardware degradations can be referred to as: $V_{mura}$, $V_{Th}$, $V_{OLED}$, and $V_{efficiency}$. Each of the hardware degradations can be mapped to corresponding increments in data steps according to a function of $V_{mura}$, $V_{Th}$, $V_{OLED}$, $V_{efficiency}$, $D(V_{mura}, V_{Th}, V_{OLED}, V_{efficiency})$. For example, the relationship can be given by Expression 1: $D(V_{mura}, V_{Th}, V_{OLED}, V_{efficiency})=\text{int}[(2^{nBits}-1)\ (V_{mura}+V_{Th}+V_{OLED}+V_{efficiency})/V_{Max}]$, where nBits is the number of bits in the data set being compensated and $V_{Max}$ is the maximum programming voltage. In Expression 1, int[ ] is a function that evaluates the contents of the brackets and returns the nearest integer. The degradation data 336 sent to the digital data processor block 306 can be digital data created according to the relationship for $D(V_{mura}, V_{Th}, V_{OLED}, V_{efficiency})$ provided in Expression 1. In an implementation of the present disclosure, the degradation data 336 can be an array of digital data corresponding to an amount of compensation to be applied to the compressed data of each pixel in an AMOLED display. The array of digital data is a set of offset increments that can be applied to the compressed data by adding the offset increments to the compressed data of each pixel or by subtracting the offset increments from the compressed data of each pixel. The set of offset increments can generally be a set of digital data with entries corresponding to an amount of compensation needed to be applied to each pixel in the AMOLED display. The amount of compensation can be the amount of increments in data steps needed to compensate for a degradation according to Expression 1. In a configuration, locations in the array of the degradation data 336 can correspond to locations of pixels in the AMOLED display.

For example, Table 1 below provides a numerical example of the compression of input data according to FIG. 13. Table 1 provides example values for a set of input data 304 following the multiplication by four (310) and the multiplication by K (314). In the example provided in Table 1, K has a value of 0.75. In Table 1, the first column provides example values of integer numbers in the set of input data 304. The second column provides example values of integer numbers in the set of resulting data 312 created by multiplying the corresponding input data values by four (310). The third column provides example values of numbers in the set of compressed data 316 created by multiplying the corresponding values of the resulting data 312 by K, where K has an example value of 0.75. The final column is the output voltage corresponding to the example compressed data 316 shown in the third column when no compensation is applied. The final column is created for an example display system having a maximum programming voltage of 18 V. In the numerical example illustrated in Table 1, the programming output voltage corresponding to the input data with the maximum input of two-hundred fifty-five is more than 4.5 V below the maximum voltage. The 4.5 V can be considered the compensation budget of the display system, and can be referred to as the voltage headroom, $V_{headroom}$. According to an aspect of the present disclosure, the 4.5 V is used to provide compensation for degradation of pixels in the AMOLED display.

TABLE 1

Numerical Example of Input Data Compression

| Input Data | Resulting Data (×4) | Compressed Data (×0.75) | Output Voltage (without degradation compensation) |
|---|---|---|---|
| 255 | 1020 | 765 | 13.46 V |
| 254 | 1016 | 762 | 13.40 V |
| 253 | 1012 | 759 | 13.35 V |
| . . . | . . . | . . . | . . . |
| 2 | 8 | 6 | 0.10 V |
| 1 | 4 | 3 | 0.05 V |
| 0 | 0 | 0 | 0.00 V |

According to an implementation of the present disclosure, the amount of voltage available for providing compensation degradation is $V_{headroom}$. An amount of $V_{headroom}$ can be advantageously reserved to compensate for a degradation of a pixel in an AMOLED display with the most severe luminance degradation. By reserving an amount of $V_{headroom}$ to compensate for the most severely degraded pixel, the relative luminosity of the display can be advantageously maintained. The required amount of $V_{headroom}$ to compensate for the pixel in an AMOLED display with a maximum amount of degradation is given by Expression 2: $V_{headroom}=\max[V_{mura}+V_{Th}+V_{OLED}+V_{efficiency}]$. In Expression 2, $V_{mura}$, $V_{Th}$, $V_{OLED}$, and $V_{efficiency}$ can each be an array of values corresponding to the amount of additional voltage necessary to compensate the pixels in the display, and the entries in the arrays of values can correspond to individual pixels in the display. That is, $V_{mura}$ can be an array of voltages required to compensate display mura or non-uniform defects; $V_{Th}$ can be an array of voltage thresholds of drive TFTs of pixels in the display; $V_{OLED}$ can be an array of OLED voltages of the pixels in the display; and $V_{efficiency}$ can be an array of voltages required to compensate for OLED efficiency degradations of pixels in the display. In Expression 2, max[ ] is a function evaluating an array of values in the brackets and returning the maximum value in the array.

As can be appreciated with reference to FIG. 13 and Table 1, the choice of K affects the amount of $V_{headroom}$ available to compensate for degradations in the display. Choosing a lower value of K leads to a greater amount of $V_{headroom}$. In a configuration of the present disclosure where the need for compensation increases over time due to aging of the display, the value of K can be advantageously decreased over time according to the degradation of the display over time. Decreasing K enables uniformity compensation across the display such that pixels receiving the same digital input data actually emit light with the same luminance, but the uniformity compensation comes at the cost of overall luminance reduction for the entire display. FIGS. 14 through 17 provide methods for selecting and adjusting K.

Figure 14:
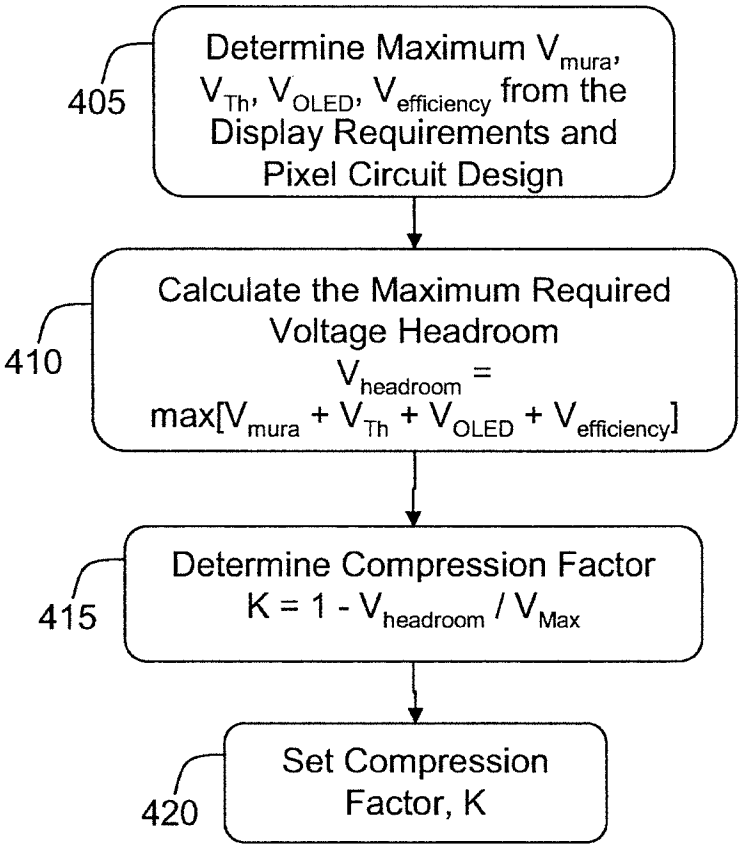
FIG. 14 is a flowchart illustrating a method for selecting the compression factor according to display requirements and the design of the pixel circuit.

FIG. 14 is a flowchart illustrating a method for selecting the compression factor according to display requirements and the design of the pixel circuit. In operation of the method illustrated by the flowchart in FIG. 14, the display requirements and pixel circuit design of a display are analyzed to estimate maximum values of $V_{mura}$, $V_{Th}$, $V_{OLED}$, and $V_{efficiency}$ for the pixels in the display (405). The estimation (405) can be carried out based on, for example, empirical data from experimental results related to the aging of displays incorporating pixel circuits similar to the pixel circuit in the display 100. Alternatively, the estimation (405) can be carried out based on numerical models or software-based simulation models of anticipated performances of the pixel circuit in the display 100. The estimation (405) can also account for an additional safety margin of headroom voltage to account for statistically predictable variations amongst the pixel circuits in the display 100. Responsive to the estimation (405), the required voltage headroom is calculated (410). The required voltage headroom, $V_{headroom}$, is calculated according to Expression 2. Once $V_{headroom}$ is calculated, the compression factor, K, is calculated (415) according to Expression 3: $K=1-V_{headroom}/V_{Max}$, where $V_{Max}$ is a maximum programming voltage for the display 100. The compression factor, K, is then set (420) for use in the compression and compensation algorithm, such as the compression algorithm illustrated in the data flow chart in FIG. 13.

Figure 15:
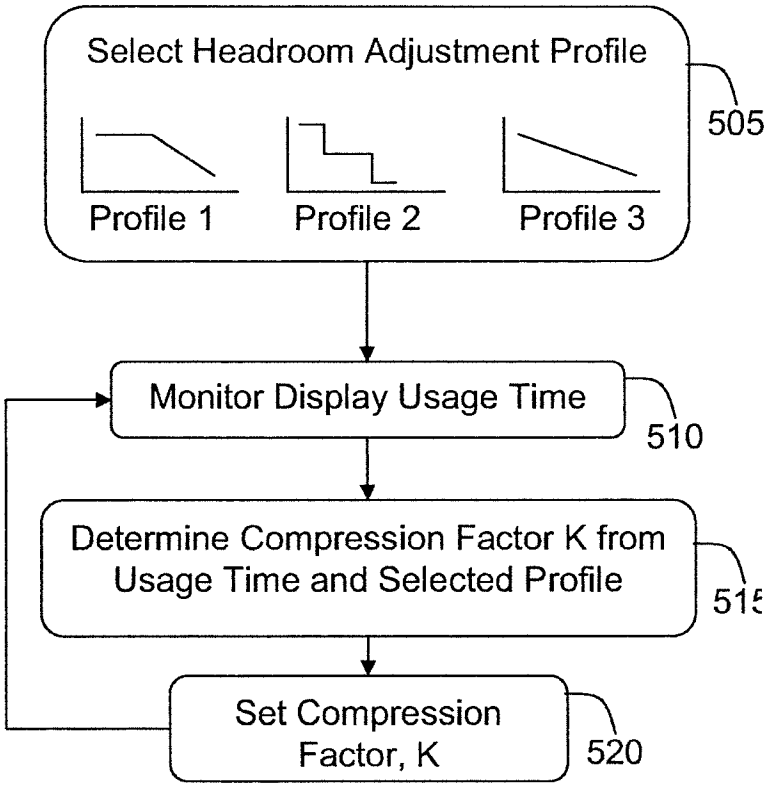
FIG. 15 is a flowchart illustrating a method for selecting the compression factor according to a pre-determined headroom adjustment profile.

FIG. 15 is a flowchart illustrating a method for selecting the compression factor according to a pre-determined headroom adjustment profile. A headroom adjustment profile is selected (505). The first block 505 in the flowchart in FIG. 15 graphically illustrates three possible headroom adjustment profiles as profile 1, profile 2, and profile 3. The profiles illustrated are graphs of K versus time. The time axis can be, for example, a number of hours of usage of the display 100. In all three profiles K decreases over time. By decreasing K over time, an additional amount of voltage ($V_{headroom}$) is available for compensation. The example profiles in the first block 505 include profile 1, which maintains K at a constant level until a time threshold is reached and K decreases linearly with usage time thereafter. Profile 2 is a stair step profile, which maintains K at a constant level for a time, and then decreases K to a lower value, when it is maintained until another time, at which point it is decreased again. Profile 3 is a linear decrease profile, which provides for K to gradually decrease linearly with usage time. The profile can be selected by a user profile setting according to a user's preferences for the compensation techniques employed over the life of the display. For example, a user may want to maintain an overall maximum luminance for the display for a specific amount of usage hours before dropping the luminance. Another user may be fine with gradually dropping the luminance from the beginning of the display's lifetime.

Once an headroom adjustment profile is selected (505), the display usage time is monitored (510). At a given usage time, the value of the compression factor, K, is determined according to the usage time and selected profile (515). The compression factor, K, is then set (520), and the display usage time continues to be monitored (510). After K is set (520), K can be used in the compression and compensation algorithm, such as the compression algorithm illustrated in the data flow chart in FIG. 13. According to an aspect of the present disclosure, the method of setting and adjusting K shown in FIG. 15 is a dynamic method of setting and adjusting K, because the value of K is updated over time according to the usage time of the display 100.

Figure 16:
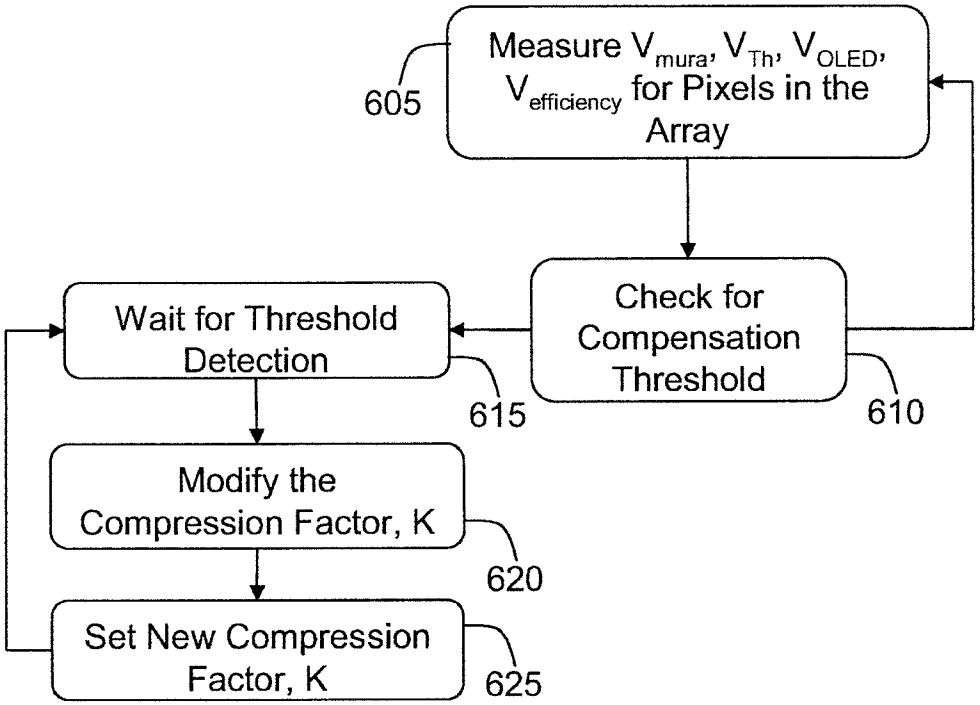
FIG. 16 is a flowchart illustrating a method for selecting the compression factor according to dynamic measurements of degradation data exceeding a threshold over a previous compensation.

FIG. 16 is a flowchart illustrating a method for selecting the compression factor according to dynamic measurements of degradation data exceeding a threshold over a previous compensation. Measurements are taken from aspects of the pixel circuits of the pixels in the display 100 to measure $V_{mura}$, $V_{Th}$, $V_{OLED}$, and $V_{efficiency}$ (605) and compute $V_{headroom}$ according to Expression 2. The difference between the value of $V_{headroom}$ presently computed at time t2 is then compared to the value of $V_{headroom}$ computed at an earlier time t1 by computing the difference (610). The difference is $\Delta V_{headroom}$, and is calculated according to Expression 5: $\Delta V_{headroom}=(V_{headroom})_{t2}-(V_{headroom})_{t1}$. In Expression 5, t1 is the last time used to adjust the compensation factor, K, and t2 is a present time. The subscripts in the right hand side of Expression 5 indicate a time of evaluation of the quantity in parentheses.

The calculated value of $\Delta V_{headroom}$ is then compared to a compensation threshold, $V_{thresh}$ (615). If $\Delta V_{headroom}$ exceeds $V_{thresh}$, K is modified (620). If $\Delta V_{headroom}$ is less than or equal to $V_{thresh}$, K is not modified. The value of K can be modified according to Expression 6: $K_{new}=K_{old}/A-B$, where $K_{new}$ is the new value of K, $K_{old}$ is the old value of K, and A and B are values set for applications and different technologies. For example, A and B can be set based on empirical results from experiments examining the characteristic degradation due to aging of pixel circuits similar to those used in the display 100 to drive OLEDs in each pixel. Similar measurements or user inputs can be used to set $V_{thresh}$ as well. The compression factor, K, is then set (625) for use in the compression and compensation algorithm, such as the compression algorithm illustrated in the data flow chart in FIG. 13. Degradation measurements continue to be measured (605), $\Delta V_{headroom}$ continues to be calculated (610), and K is updated according to Expression 6 whenever $\Delta V_{headroom}$ exceeds $V_{thresh}$ (620). According to an aspect of the present disclosure, the method of adjusting K shown in FIG. 16 is a dynamic method of adjusting K, because the value of K is updated over time according to degradation measurements gathered from the pixel circuits within the display 100.

Alternatively, the compression factor can be modified (620) according to Expression 3 based on the measured $V_{headroom}$. According to an aspect of the method provided in the flowchart shown in FIG. 16, the value of K is maintained until a threshold event occurs (615), when K is modified (620). Implementing the method provided in FIG. 16 for adjusting the compression factor, K, can result in K being decreased over time according to a stair step profile.

Figure 17:
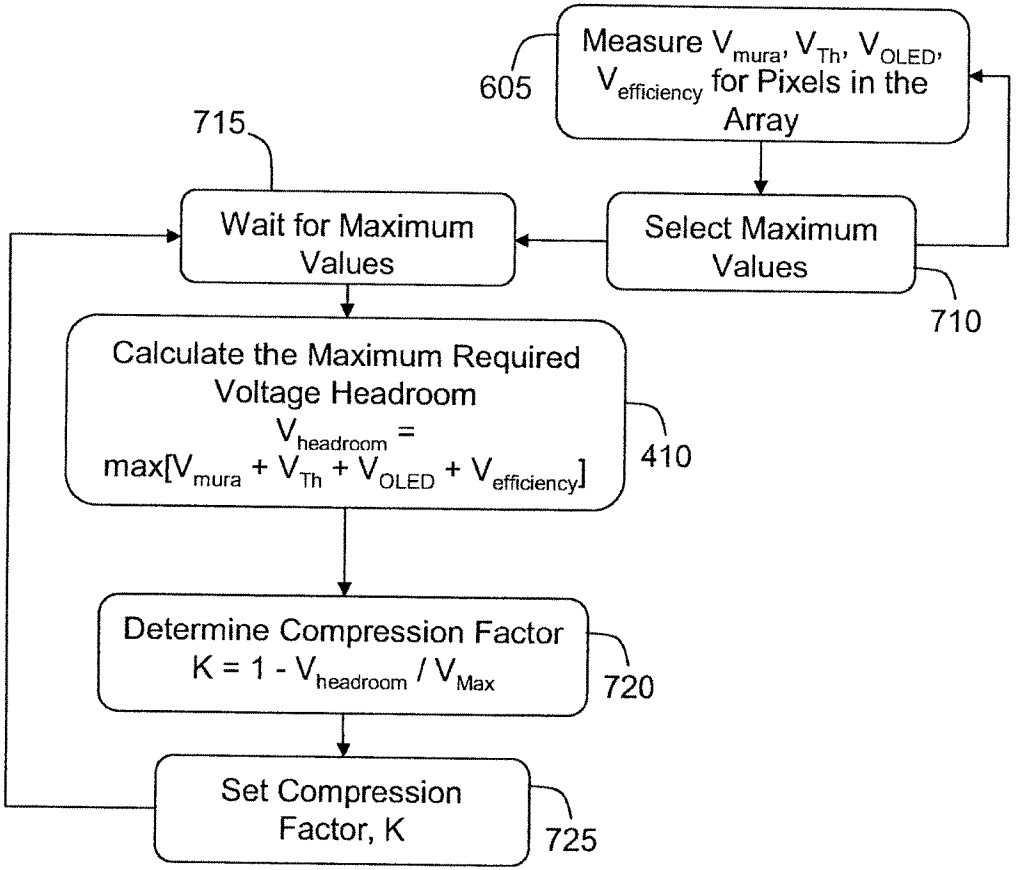
FIG. 17 is a flowchart illustrating a method for selecting the compression factor according to dynamic measurements of degradation data exceeding a previously measured maximum.

FIG. 17 is a flowchart illustrating a method for selecting the compression factor according to dynamic measurements of degradation data exceeding a previously measured maximum. Measurements are taken from aspects of the pixel circuits of the pixels in the display 100 to measure $V_{mura}$, $V_{Th}$, $V_{OLED}$, and $V_{efficiency}$ (605). The measurements of $V_{mura}$, $V_{Th}$, $V_{OLED}$, and $V_{efficiency}$ are referred to as degradation measurements. The maximum values of the degradation measurements are selected (710). The maximum values of the degradation can be selected according to Expression 2. The combination of measuring the degradation measurements (605) and selecting the maximum values (710) provides for ascertaining the maximum compensation applied to pixels within the display. The maximum values are compared to previously measured maximum values of previously measured degradation measurements (715). If the presently measured maximum values exceed the previously measured maximum values, $V_{headroom}$ is calculated according to Expression 2 (410) based on the present degradation measurements. Next, the compression factor, K, is determined according to Expression 3 (720). The compression factor is set (725) and the maximum values are updated for comparison with new maximum values (715). The compression factor is set (725) for use in the compression and compensation algorithm, such as the compression algorithm illustrated in the data flow chart in FIG. 13. Similar to the method provided in FIG. 16, the method shown illustrated by the flowchart in FIG. 17 is a dynamic method of adjusting K based on degradation measurements continually gathered from the pixel circuits within the display 100.

The present disclosure can be implemented by combining the above disclosed methods for setting and adjusting the compression factor, K, in order to create an adequate amount of voltage headroom that allows for compensation to be applied to the digital data before it is passed to the data driver IC. For example, a method of setting and adjusting K according to FIG. 16 or FIG. 17 can also incorporate a user selected profile as in FIG. 15.

In an implementation of the present disclosure, the methods of selecting and adjusting the compression factor, K, provided in FIGS. 14 through 17 can be used in conjunction with the digital data manipulations illustrated in FIG. 13 to operate a display while maintaining the uniform luminosity of the display. In a configuration, the above described methods allow for maintaining the relative luminosity of a display by compensating for degradations to pixels within the display. In a configuration, the above described methods allow for maintaining the luminosity of a pixel in a display array for a given digital input by compensating for degradations within the pixel's pixel circuit.

Figure 18:
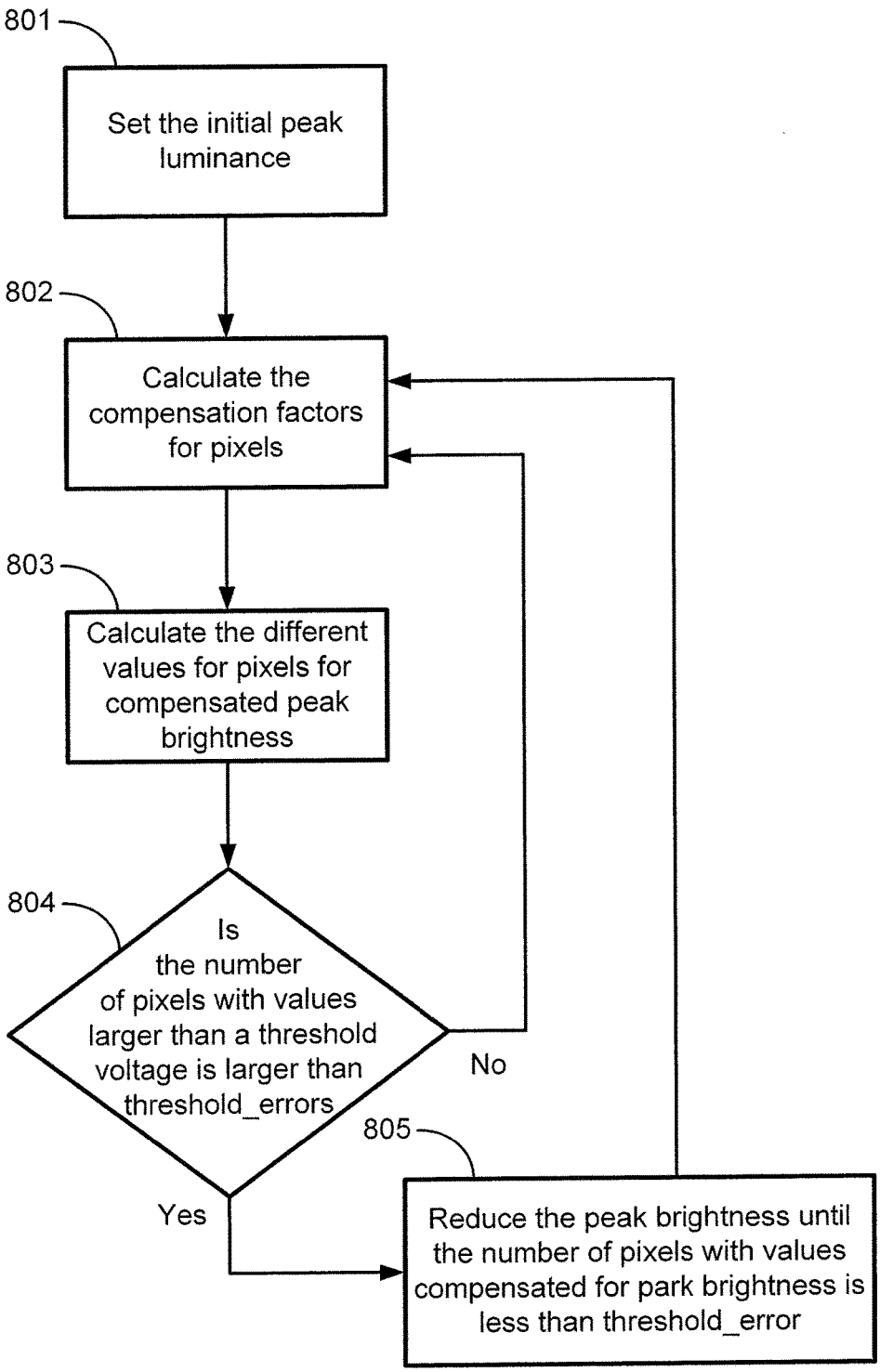
FIG. 18 is a flowchart illustrating a method for periodically adjusting the peak luminance for compensation.

FIG. 18 is a flow chart illustrating a method of periodically adjusting the peak luminance for compensation. The initial peak luminance set by the display at step 801 is adjusted based on compensation levels at step 802. After calculating the compensated value for each pixel to provide the peak brightness at step 803, the number of pixels whose values are larger than a threshold voltage is calculated at step 804. If this number is larger a threshold number (threshold_error), the peak luminance (brightness) is reduced at step 805 until the number is less than threshold_error.

1. Initial brightness can be set by applications or an algorithm that controls the power, temperature, or any other display factors.
2. The pixel values can be the data passed to the display driver, the pixel luminance or the pixel currents. One can calculate more than one pixel value to compare with more than one threshold value.

3. The threshold values can be set based on different conditions such as the maximum compensated headroom available and aging acceleration factors. For example, as the current of the pixel is increased to compensate for the OLED aging, the OLED aging accelerates. Therefore, one can set a threshold value to limit the aging acceleration. The threshold values can be more than one and can be different for each subpixel.
4. The threshold_error can be set as the maximum tolerable number of pixels having the wrong compensation level. There can be different threshold_error values for different threshold (pixel) values.
5. In the case of multiple threshold values, there can be a priority list in which the conditions of the values with higher priority need to be fixed first.
6. The compensation factors can include uniformity compensation, aging compensation, temperature compensation, and other adjustments related to display performance.
7. The adjustment can be made periodically, at an event (e.g., power on, power off, readjusting the compensation factors, etc.) or at user (application) request.

Figure 19:
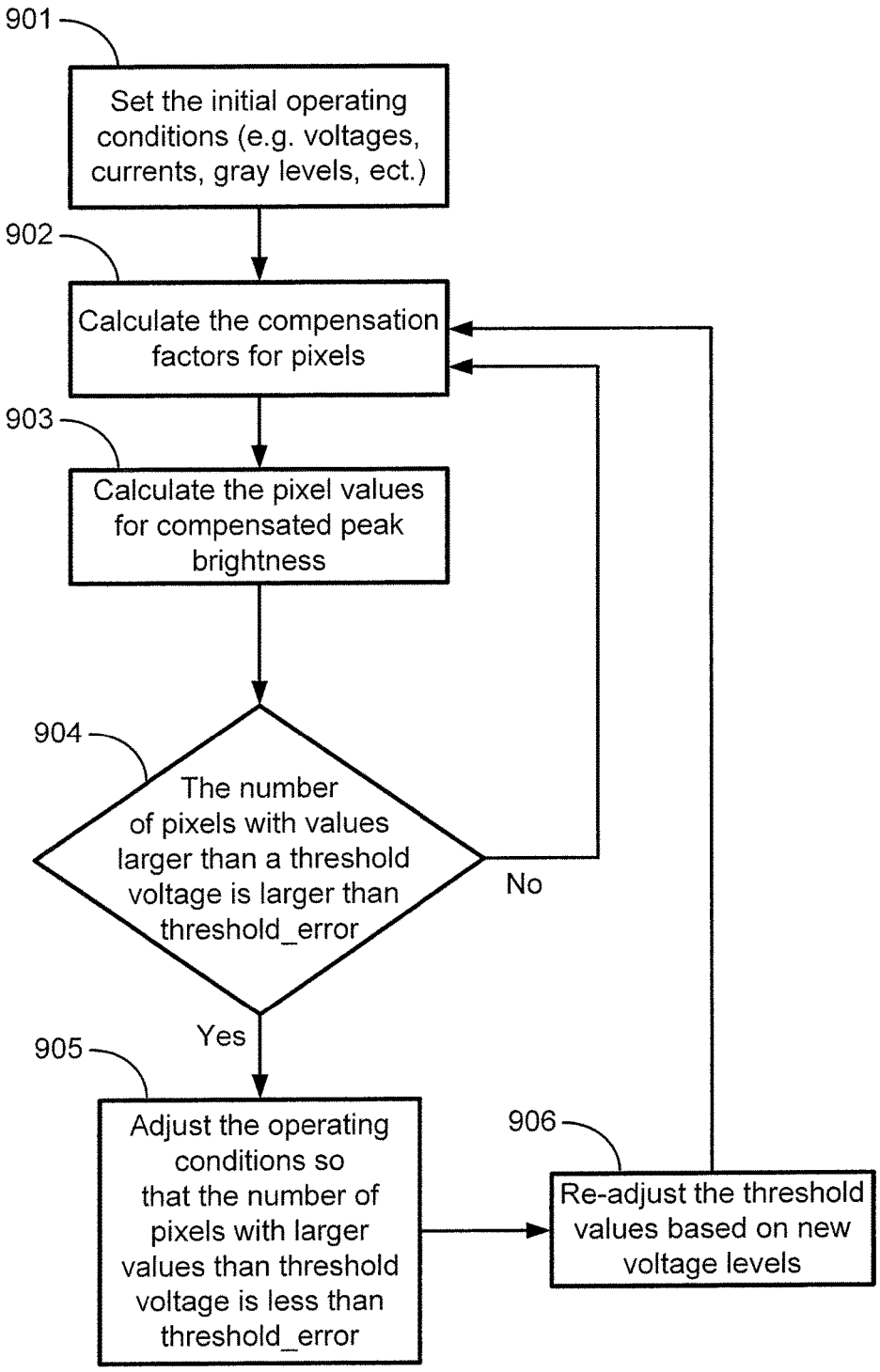
FIG. 19 is a flowchart illustrating a method for periodically adjusting operating conditions for compensation.

FIG. 19 is a flow chart illustrating a method of periodically adjusting the operating conditions for compensation. The initial operating conditions (e.g., voltages, currents, gray levels, etc.) are set at step 901, and the compensation factors for the pixels are calculated at step 902. After calculating the pixel values for compensated peak brightness at step 903, the number of pixels whose values are larger than a threshold value is calculated at step 904. If this number is larger than a threshold number (threshold_error), the operating conditions are adjusted at step 905 so that the number of pixels with values larger than the threshold is less than threshold_error. Then at step 906 the threshold values are re-adjusted based on the new voltage levels.

1. Initial operating conditions can be set by applications or an algorithm that controls the power, temperature, or any other display factors.
2. Pixel values can be the data passed to the display driver, the pixel luminance or the pixel currents. One can calculate more than one pixel value to compare with more than one threshold value.
3. The threshold values can be set based on different conditions such as the maximum compensated headroom available.
4. The threshold_error can be set as the maximum tolerable pixels with wrong compensation levels. There can be different threshold errors for different threshold (pixel) values.
5. The compensation factors can include uniformity compensation, aging compensation, temperature compensation, and other adjustments related to display performance.
6. In case of multiple threshold values, there can be a priority list in which the conditions of the values with higher priority need to be fixed first.
7. The adjustment can be made periodically, at an event (e.g., power on, power off, readjusting the compensation factors, etc.) or at user (application) request.

A combination of luminance adjustment and display operating conditions, i.e., a hybrid adjustment, may be used to meet the threshold_error values.

1. In one case, different threshold values are allocated to different parameters (e.g., some are allocated to the luminance adjustment and some to the display operation conditions). For example, the aging acceleration factor threshold value can be allocated to the luminance adjustment, and the uniformity value can be allocated to the display operation condition algorithm. Also, some threshold values can have priority over others so that the higher priority values are fixed first.
2. In another case, there can be a percentage correction for each parameter. For example, the maximum change in the luminance (or the rate of luminance reduction) can be limited. In this case, if there are some threshold errors left after adjusting the luminance according the allowable rate, they are fixed by the operation condition adjustment.
3. In another case, one can use a mixture of the two aforementioned cases (some threshold values are controlled by specific parameters (e.g., aging acceleration is controlled by a luminance adjustment algorithm), and some threshold values are allocated to both algorithms.

The present disclosure describes maintaining uniform luminosity of an AMOLED display, but the techniques presented are not so limited. The disclosure is applicable to a range of systems incorporating arrays of devices having a characteristic stimulated responsive to a data input, and where the characteristic is sought to be maintained uniformly. For example, the present disclosure applies to sensor arrays, memory cells, and solid state light emitting diode displays. The present disclosure provides for modifying the data input that stimulates the characteristic of interest in order to maintain uniformity. While the present disclosure for compressing and compensating digital luminosity data to maintain a luminosity of an AMOLED display is described as utilizing TFTs and OLEDs, the present disclosure applies to a similar apparatus having a display including an array of light emitting devices.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A display system comprising:

a plurality of pixel circuits arranged in an array, each pixel circuit including a light emitting device and at least one thin film transistor (TFT);

a measurement circuit for measuring, independently for each individual pixel circuit of the plurality of pixel circuits, at least one of a voltage and a current of the at least one TFT of the individual pixel circuit independent of a degradation of the light emitting device of the individual pixel circuit and without directly measuring a light output from the light emitting device of the individual pixel circuit, generating measured TFT electrical data for each individual pixel circuit representing the at least one of a voltage and a current of the at least one TFT of the individual pixel circuit;

a TFT-to-Pixel conversion algorithm module for estimating a luminance degradation of each individual pixel circuit with use of a value of the at least one of a voltage and a current of the at least one TFT of the individual pixel represented by the measured TFT electrical data and at least one additional input; and a compensation module for compensating for non-uniformity in the display system based on the estimated luminance degradation of each individual pixel circuit.

2. The display system of claim 1, wherein the compensation module further compensates for changes in the display system due to at least one condition of each individual pixel circuit or the display system represented by the at least one additional input.

3. The display system of claim 1, wherein the at least one additional input includes at least one of a temperature reading, a mechanical stress reading, an environmental stress reading, and feedback from a test structure in the display system.

4. The display of claim 1, wherein the TFT-to-Pixel conversion algorithm module further estimates the luminance degradation of each individual pixel circuit with use of one or more empirical parameters.

5. The display of claim 4, wherein the one or more empirical parameters include at least one of brightness loss in an organic light emitting device (OLED) of the pixel circuit due to decreasing efficiency (ΔL), shift in the OLED's voltage over time (ΔVoled), dynamic effects of Vt shift, parameters related to TFT performance including Vt, ΔVt, mobility (μ), inter-pixel non-uniformity, DC bias voltages in the pixel circuit, changing gain of current-mirror based pixel circuits, short-term and long-term based shifts in pixel circuit performance, and pixel-circuit operating voltage variation due to IR-drop and ground bounce.

6. The display of claim 1, wherein the non-uniformity in the display system includes at least one of a brightness non-uniformity and a color non-uniformity.

7. The display of claim 1, wherein the measured TFT electrical data includes TFT degradation data.

8. The display of claim 1, wherein the measurement circuit is further for measuring at least one of a voltage and a current of the individual pixel circuit dependent upon the degradation of the light emitting device of the individual pixel circuit and without directly measuring a light output from the light emitting device of the individual pixel circuit, generating measured electrical data representing the at least one of a voltage and a current of the individual pixel circuit, the measured electrical data including light emitting device degradation data, and wherein the TFT-to-Pixel conversion algorithm module estimates said luminance degradation of each individual pixel circuit with use of a value of the at least one of a voltage and a current of the individual pixel circuit represented by the measured electrical data.

* * * * *